United States Patent [19]

Histed et al.

[11] 4,013,506

[45] Mar. 22, 1977

[54] METHOD AND APPARATUS FOR AUTOMATICALLY AND SIMULTANEOUSLY CONTROLLING SOLUTION VISCOSITY AND BRIGHTNESS OF A PULP DURING MULTI-STAGE BLEACHING

[75] Inventors: John A. Histed, L'Orignal; William H. Lawford; Murray J. McLeod, both of Hawkesbury, all of Canada

[73] Assignee: Canadian International Paper Company, Montreal, Canada

[22] Filed: July 22, 1974

[21] Appl. No.: 490,324

[52] U.S. Cl. ..... 162/49; 162/238; 162/DIG. 10

[51] Int. Cl.[2] ..... D21C 9/14; D21C 9/10

[58] Field of Search ..... 162/198, 263, 49, 238, 162/252, DIG. 10; 68/181 R

[56] References Cited

UNITED STATES PATENTS

| | | | |
|---|---|---|---|
| 3,035,967 | 5/1962 | Sacksen et al. | 162/198 X |
| 3,465,550 | 9/1969 | Strum et al. | 162/238 |
| 3,729,375 | 4/1973 | Chappelle | 162/49 X |
| 3,764,463 | 10/1973 | Histed et al. | 162/49 |

OTHER PUBLICATIONS

Obenshain; "Black Widow Bleaching Control System," pp. 1–9, Tappi; vol. 41, No. 1, Jan. 1958.

Strom, "Improved Chlorination Control by Color Measurement," Tappi; Nov. 1973, vol. 56, No. 11.

*Primary Examiner*—Robert L. Lindsay, Jr.

*Assistant Examiner*—Steve Alvo

[57] ABSTRACT

A method and apparatus are provided for automatically and simultaneously controlling the solution viscosity and degree of brightness of a pulp during a bleaching process which employs a sequence of chlorination, hypochlorite and chlorine dioxide bleaching reagents. The pulp is monitored during the bleaching sequence by employing an optical device utilizing reflected light of one or two wavebands. The optical monitoring device electronically feeds a control signal to a regulator or computer which regulates the input of one or more of the bleaching reagents. The amounts of reagents added are based upon and made possible by relationships which have now been determined between the light reflectance values of the pulp at various stages of the process and desired viscosity and brightness values. The viscosity is controlled by controlling the hypochlorite addition and the brightness of the fully bleached pulp is controlled by chlorine dioxide addition.

28 Claims, 18 Drawing Figures

STORAGE
TSP
D
MIX
$ClO_2$
FIC
SM
E
NaOH
H
MIXER
$NaOCl_2$
COMPUTER
C
PULP
FM
$Cl_2$

VISCOSITY CONTOURS VS CHLORINE APPLIED IN CHLORINATION AND REFLECTANCE VALUES AFTER HYPOCHLORITE BLEACHING IN THE $CNE_HD$ SEQUENCE.

REFLECTANCE CONTOURS AFTER HYPOCHLORITE BLEACHING VS REFLECTANCE VALUES AFTER THE NEUTRALIZATION STAGE AND HYPOCHLORITE APPLIED IN THE $E_H$ STAGE OF THE $CNE_HD$ SEQUENCE

CONTOURS OF FULLY BLEACHED BRIGHTNESS VS. REFLECTANCE VALUES AFTER THE HYPOCHLORITE STAGE AND CHLORINE DIOXIDE APPLIED IN THE FINAL BLEACH STAGE OF THE $CNE_HD$ SEQUENCE.

VISCOSITY CONTOURS VS REFLECTANCE VALUES AFTER THE NEUTRALIZATION STAGE AND HYPOCHLORITE APPLIED IN THE $E_H$ STAGE OF THE $CNE_HD$ SEQUENCE.

VISCOSITY CONTOURS OF FULLY BLEACHED PULP VS CHLORINE APPLIED IN CHLORINATION AND REFLECTANCE VALUES MEASURED 6 MINUTES AFTER HYPOCHLORITE ADDITION IN THE $E_H$ STAGE OF THE $CNE_HD$ SEQUENCE.

CONTOURS OF FULLY BLEACHED BRIGHTNESS VS. REFLECTANCE VALUES MEASURED AFTER 6 MINUTES OF THE $E_H$ STAGE AND $ClO_2$ APPLIED IN THE FINAL STAGE OF THE $CNE_HD$ SEQUENCE.

VISCOSITY CONTOURS OF FULLY BLEACHED PULP VS. CHLORINE APPLIED IN CHLORINATION AND REFLECTANCE VALUES AFTER HYPOCHLORITE BLEACHING IN THE CEHED SEQUENCE.

REFLECTANCE CONTOURS AFTER HYPOCHLORITE BLEACHING VS. REFLECTANCE VALUES AFTER THE FIRST EXTRACTION STAGE AND HYPOCHLORITE CONSUMED IN THE H STAGE OF THE CEHED SEQUENCE.

CONTOURS OF FULLY BLEACHED BRIGHTNESS VS. REFLECTANCE VALUES AFTER THE SECOND EXTRACTION STAGE AND CHLORINE DIOXIDE APPLIED IN THE FINAL BLEACH STAGE OF THE CEHED SEQUENCE.

VISCOSITY CONTOURS OF FULLY BLEACHED PULP VS. CHLORINE APPLIED IN CHLORINATION AND REFLECTANCE ON UNWASHED HYPOCHLORITE BLEACHED PULP FROM THE CEHED SEQUENCE.

CONTOURS OF FULLY BLEACHED BRIGHTNESS VS. REFLECTED VALUES MEASURED ON UNWASHED H STAGE PULP AND CHLORINE DIOXIDE APPLIED IN THE FINAL BLEACH STAGE OF THE CEHED SEQUENCE.

RELATION BETWEEN CHLORINE APPLIED FOR CHLORINATION AND KAPPA NO. OF THE UNBLEACHED PULP FOR TWO TYPES OF SOFTWOOD KRAFT PULP.

RELATIONSHIP BETWEEN CHLORINE APPLIED FOR CHLORINATION AND VISCOSITY OF THE UNBLEACHED PULP FOR TWO TYPES OF KRAFT SOFTWOOD PULP.

METHOD AND APPARATUS FOR AUTOMATICALLY AND SIMULTANEOUSLY CONTROLLING SOLUTION VISCOSITY AND BRIGHTNESS OF A PULP DURING MULTI-STAGE BLEACHING

BACKGROUND OF THE INVENTION

The invention relates to a system for automatically controlling the operation of a pulp bleachiing operation by means of one or more chromatic sensors employing one or more wavelengths of light for monitoring the reflectances of the pulp slurry during the bleaching process.

It is an established practice in the pulp processing industry to optically monitor samples of pulp slurry in order to control either manually or automatically certain factors in the treatment of the pulp at different stages of the processing operation. Many of the optical measuring devices in these prior systems utilize the light reflectance characteristics of a sample of pulp slurry in one form or another or at one stage or another. Some devices simply measure the brightness of the pulp slurry at one waveband. In other devices the reflectance is measured through polarizing systems which determine gloss. In still other devices the luminosity of the pulp slurry is optically measured.

In general such systems are of two types: the optical information obtained is used to control changes upstream from the measurement, which is called a "feedback" system, or the information is used to control treatment downstream from the measurement, which is called a "feed forward" system. In the present system feedback and/or feed forward control may be employed.

Control of pulp solution viscosity, as measured by TAPPI Standard T230 or some other method, is desirable since this property is related to the strength potential of the pulp and to its beating characteristics. Beating is a mechanical treatment used to enhance fiber bonding and paper strength. A very high viscosity pulp is strong but requires high inputs of energy to beat the pulp to develop its potential physical strength. On the other hand, very low viscosity pulp has low strength potential and requires less beating energy input. The most desirable pulp characteristics for papermaking fall somewhere between these extremes. Pulp with very high viscosity can be bleached with hypochlorite to reduce its viscosity and provided this is not overdone there is only a slight loss in strength potential but a relatively large decrease in the power required to beat the pulp. Therefore, viscosity control allows the papermaker to obtain the desired balance between strength and power consumption in the beating operation.

Although optical control systems have been available to control pulp brightness in the past, so far as we are aware, optical control systems have never been used during bleaching procedures to control both the solution viscosity and brightness of the pulp simultaneously. Viscosity control is an important consideration since unbleached pulp which is to undergo a bleaching operation can vary over a wide range of viscosities, depending on the nature of the preceding cooking treatment. Not only is it desirable to control the bleached brightness, but to prevent undue reduction of the viscosity of the pulp as a result of the bleaching treatment. Pulps which have too low a viscosity may have to be culled. It is also undesirable that the pulp have too high a viscosity since this requires extra beating of the pulp in order to develop the desired strength properties in the pulp. It is present day commercial practice to control bleached pulp brightness by making adjustments to chemical additions based on feedback information from manually prepared and measured brightness sheets. A degree of viscosity control, almost solely to avoid low viscosity levels, is practiced, but based on feedback information from manually tested samples.

Bleaching of wood pulp customarily involves a sequence of steps designed to increase the brightness of the pulp, while minimizing degradation of the pulp by the chemical bleaching agents employed. Most bleaching processes employ an initial chlorination stage. The use of hypochlorites in a succeeding stage is often considered judicious since it increases the brightness of the pulp economically but must be carefully controlled to avoid undue degradation of the strength potential of the pulp. The use of chlorine dioxide in a further successive or final stage of the bleaching process is now widely used since it also has advantageous properties in increasing brightness, without undue loss of viscosity.

SUMMARY OF THE INVENTION

The present invention comprises a method and apparatus for automatically and simultaneously controlling the viscosity and the degree of bleaching (brightness) of a pulp during a bleaching process which employs in its sequence a hypochlorite stage. During the process, the pulp is monitored as it flows through the process by one or more well known optical monitoring devices utilizing reflected light of one or two wavebands of light. Where reflectance at two predetermined wavebands is employed, a composite function of the reflectances (sums, differences or ratios) is measured by the sensing device. The optical monitoring device or sensor generates an electrical signal which automatically controls the amounts of bleaching reagents employed in the bleaching process. At least one of the optical monitoring devices is placed prior to or subsequent to the hypochlorite treatment stage. The reflectance monitoring is done continuously on a pulp stream and it is not necessary to remove samples from the flowing pulp.

The system of the invention is applicable to bleaching sequences depicted by the following code systems with which those skilled in the bleaching art are familiar:

| | | |
|---|---|---|
| CEHDED | CNHDED | $CE_{H}DED$ |
| CEHED | CNHED | $CEDE_{H}D$ |
| CEHD | $CE_{H}D$ | CHED |
| $CEE_{H}D$ | $CNE_{H}D$ | |

Where "C" can represent chlorination, whether it is wth chlorine alone (C), chlorine dioxide alone (D), mixtures of chlorine dioxide and chlorine $C_D$) or sequential addition of chlorine dioxide and chlorine (DC).

"E" represents a hot alkaline extraction stage.

"N" represents a cold neutralization stage with alkali.

"H" represents a conventional hypochlorite stage.

"$E_H$" represents a hot alkaline extraction stage to which hypochlorite is added.

"D" represents a chlorine dioxide stage.

Other possible bleach sequences for which the system is suited will be apparent to those skilled in the art.

It has been discovered that light reflectance values at one or more predetermined wavebands bear a definite relationship to both viscosity and brightness values of cellulosic pulp. Based on these relationships, the control system of the invention permits regulation of the amount of bleaching reagents introduced at the various stages of the bleaching sequence.

In one particular advantageous embodiment, the difference in optical reflectances ($R_2$–$R_1$), or delta R, is fed into the input of a computer, which is programmed to regulate the brightness and viscosity of the pulp automatically. The computer is programmed to automatically make appropriate changes in the amounts of the various bleaching agents employed in the bleaching sequence.

In accordance with one embodiment of the invention, an optical monitoring sensor is placed either before or after the hypochlorite treatment stage. Optionally, in accordance with another embodiment of the invention, the optical monitoring sensors may be placed both before and after the hypochlorite treatment stage. The electronic output of the optical monitoring sensors is fed to a controller or computer which regulates the amount of flow of the bleaching reagents.

Because an accurate optical indication of the brightness and the viscosity of the pulp stream is made substantially instantaneously as the pulp stream flows through the bleaching system, the time delay which has plagued most prior art "feedback" systems of control is not significant in the system of the present invention.

In the process of the present invention, hypochlorite addition is varied to provide a constant viscosity. In so doing the brightness leaving the hypochlorite stage varies over a wide range depending on the cooking degree of the pulp (as shown in Example 2, below), instead of being held relatively constant as is normal practice. This variation in hypochlorite stage brightness is adjusted for in the subsequent stage to give the required final brightness.

In conventional bleacheries the aim is to have as little variation in brightness as possible entering the final bleach stage in order to maintain good control of the final brightness. The wide variations in brightness of the hypochlorite stage due to viscosity control in the process of the present invention could not be tolerated in conventional control systems.

Viscosity control in conventional bleacheries is based on the TAPPI T-230 viscosity test (or equivalent) which takes an hour to complete. Therefore the viscosity control is one to 3 hours behind the chemical addition in the process. In the process of the present invention, based on optical measurements, viscosity control is only 6 minutes behind the chemical addition and is continuous, which is not possible by conventional control means.

Thus it is submitted to be evident that the system of the present invention automatically and simultaneously controls the amount of bleaching reagents which are fed to the various stages of the bleaching reagents which are fed to the various stages of the bleaching process to provide control over the viscosity and brightness of the pulp.

It is thus an object of the present invention to provide a method and apparatus for automatically and simultaneously controlling the viscosity and degree of brightness of a pulp during the bleaching process.

It is also an object of the present invention to utilize the reflectance of the pulp stream in the course of the bleaching process to control the input of bleaching reagents at the various stages of the bleaching process.

It is still another object of the invention to optionally measure the difference in reflectance of the pulp stream during a bleaching operation at two predetermined wavebands and to use the optical information thus obtained to control the addition of reagents in the bleaching process.

The foregoing and other objectives, features and advantages of the invention will be more readily understood upon consideration of the following detailed description of certain preferred embodiments of the invention, taken in conjunction with the accompanying drawings.

DESCRIPTION OF CERTAIN PREFERRED EMBODIMENTS

While the system of the invention will be described in conjunction with the $CNE_HD$ and CEHED bleaching sequences, it will be apparent to those skilled in the art that other bleaching sequences may be employed.

Figure 1:
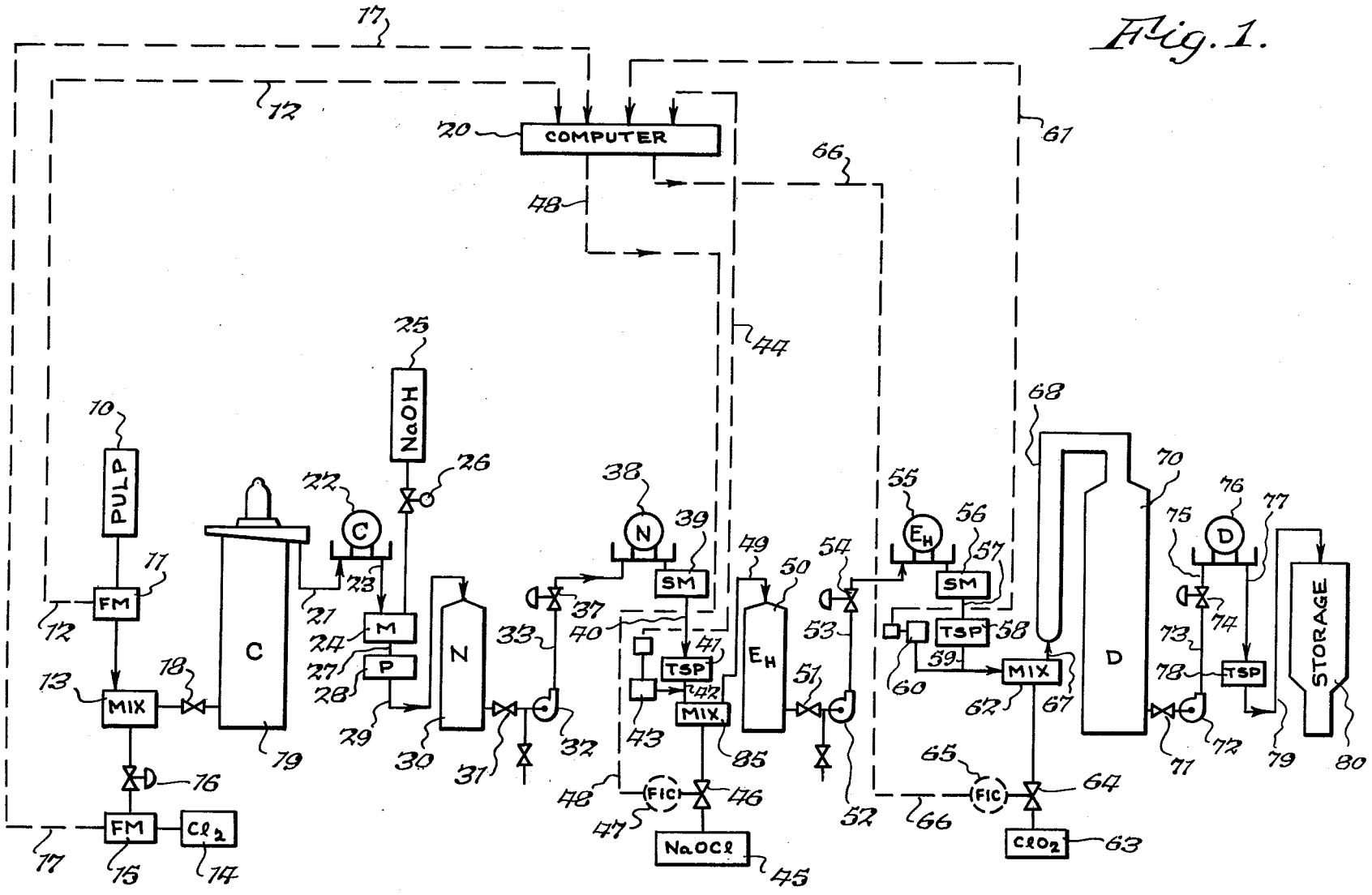
FIG. 1 is a diagrammatic view or flowsheet of one embodiment of the invention for controlling the bleaching process using the $CNE_HD$ sequence.

Referring now more particularly to FIG. 1, one of the preferred embodiments of the present invention is shown as comprising an apparatus and process for continuously bleaching pulp slurry and optically, simultaneously controlling the degree of viscosity and brightness of the pulp. This system employs the $CNE_HD$ sequence. This system requires as a prerequisite that the chorination or initial stage shall be under the control of the system, i.e., the amount of chlorine subject to regulation by the system. In this system the pulp flow and the chlorine introduced are measured and controlled by the computer. Instead of measurement of pulp flow and chlorine flow, manual tests of either unbleached Kappa No. or unbleached viscosity could be entered into the computer. However, the advantages of on-line continuous measurement would be lost.

In the system of FIG. 1, pulp (10) is passed through flow meter (11) and the flow regulated, with the flow from the flow meter (11) signaled to and controlled by computer (20) through wire (12) and the pulp mixed through mixer (13) with chlorine gas from supply (14) through flow meter (15) and through valve (16). Flow meter (15) has its rate of flow of chlorine signaled to computer (20) through wire (17). The mixture of pulp and chlorine eminating through mixer (13) then passes through shutoff valve (18) into chlorination tower (C) (19).

After the chlorination of the pulp it passes through conduit (21) and is washed over drum washer (C) (22). The washed pulp passes through line (23) into mixer (M) (24) where a solution of sodium hydroxide (25) regulated by valve (26) is mixed with it. Thereafter the mixture of washed chlorinated pulp and sodium hydroxide solution is passed through conduit (27) to pump (P) (28) then into line (29) and thence into the neutralization stage tower (N) (30). The neutralized pulp is passed through valve (31) into pump (32) and thence into line (33), through valve (37), onto drum washer (N) (38). After being washed in washer (38) the washed pulp is passed through steam mixer (SM) (39), through conduit (40), into thick stock pump (TSP) (41). After passing out pump (41) and into pipe (42) the reflectance of the pulp is read by optical reflectance monitoring sensor (43), while the pulp passes through pipe (42), and the reflectance values transmitted to computer (20) through wire (44).

The pulp then passes from line (42) into mixer (85), where it is mixed with sodium hypochlorite from container (45) with the flow of hypochlorite regulated by valve (46). The rate of flow of the sodium hypochlorite through valve (46) is regulated by flow indicating controller (FIC) (47), which is connected to the computer (20) by wire (48), whereby the computer regulates flow of sodium hypochlorite entering the mixer (85).

Upon emerging from mixer (85), the mixture of pulp and sodium hypochlorite solution passes through pipe (49) into tower ($E_H$) (50) where the hot alkaline extraction stage with sodium hypochlorite takes place. It then passes through valve (51) and pump (52) into pipe (53) and through valve (54) onto drum washer ($E_H$) (55) where it is washed. The washed pulp is passed into steam mixer (SM) (56) and then through pipe (57) into thick stock pump (TSP) (58). As the pulp leaves pump (58) and as it passes through pipe (59) its reflectance is recorded by optical reflectance monitoring sensor (60), which transmits the reflectance value to computer (20) through wire (61). The pulp then passes into mixer (62) where it is mixed with chlorine dioxide from container (63), with the flow of chlorine dioxide being regulated by valve (64) which is regulated by flow controller (FIC) (65), which is in turn controlled by the signal from computer (20) passing through wire (66).

The mixture of pulp and chlorine dioxide then passes through pipe (67) into holding tube (68) and into the reaction tower (D) (70). After reacting with the chlorine dioxide, the pulp is passed out the bottom of tower (70) through valve (71), into pump (72), then into pipe (73), through valve (74) and then by means of pipe (75) onto drum washer (D) (76), where it is washed with water. The washed pulp, having the desired viscosity and brightness, is then passed into pipe (77) and through thick stock pump (TSP) (78) and then through pipe (79) into storage vessel (80).

Figure 2:
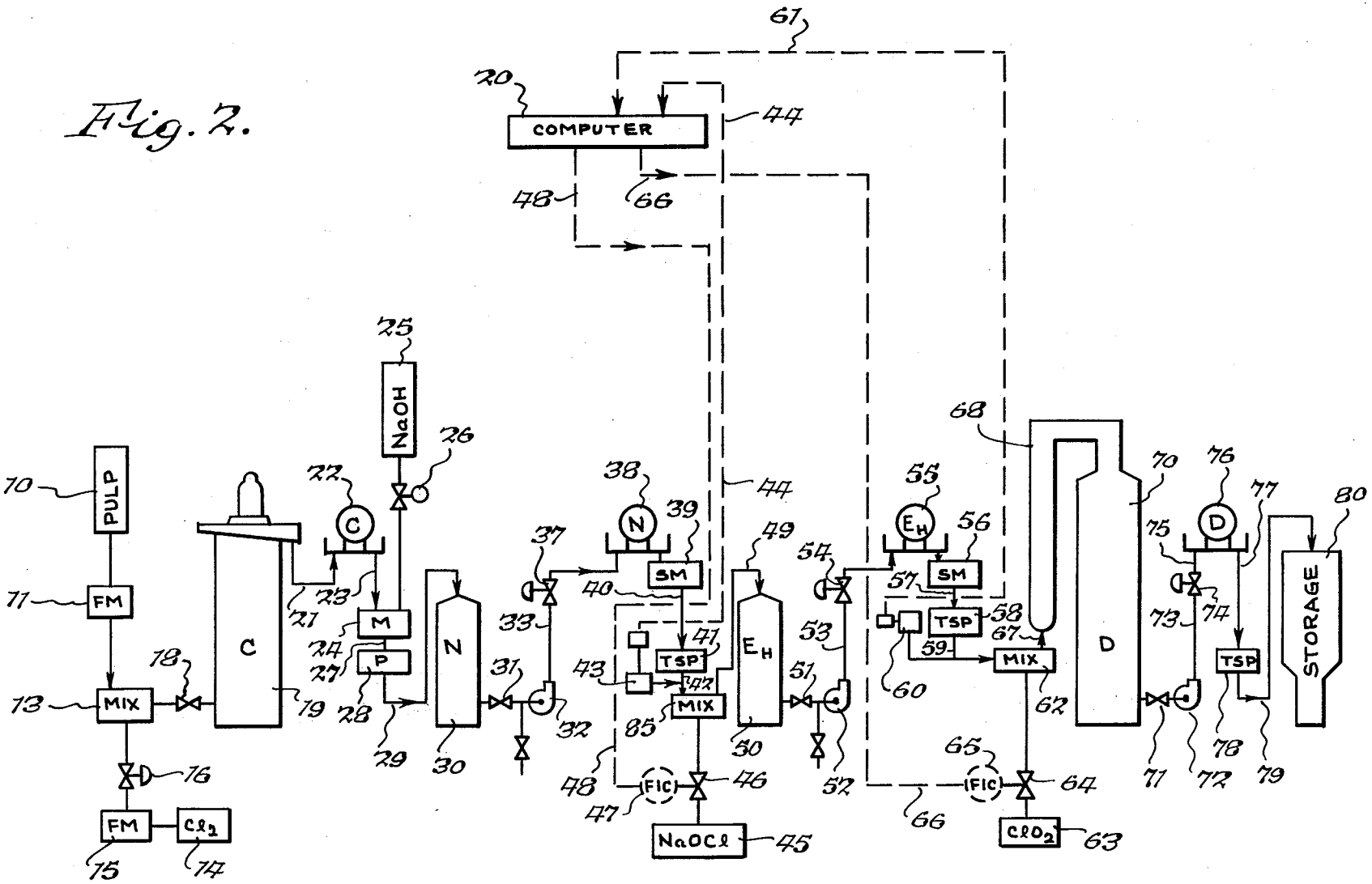
FIG. 2 is a diagrammatic view or flowsheet of another embodiment of the invention for controlling the bleaching process using the $CNE_HD$ sequence.

Another preferred embodiment of the invention is illustrated by the flowsheet of FIG. 2. This system is a more simplified version of the system of FIG. 1, differing essentially in that the flow of pulp and chlorine into chlorination tower (19) is not minitored by the computer (20). Thus there are no lines (12) and (17) connecting flow meters (11) and (15), respectively, to computer (20). Otherwise, the two systems are physically identical and like parts are similarly numbered. The system of FIG. 2 employs a direct feed forward control of the hypochlorite (viscosity control) from instrument (43) and chlorine dioxide (brightness control) from instrument (60).

Figure 3:
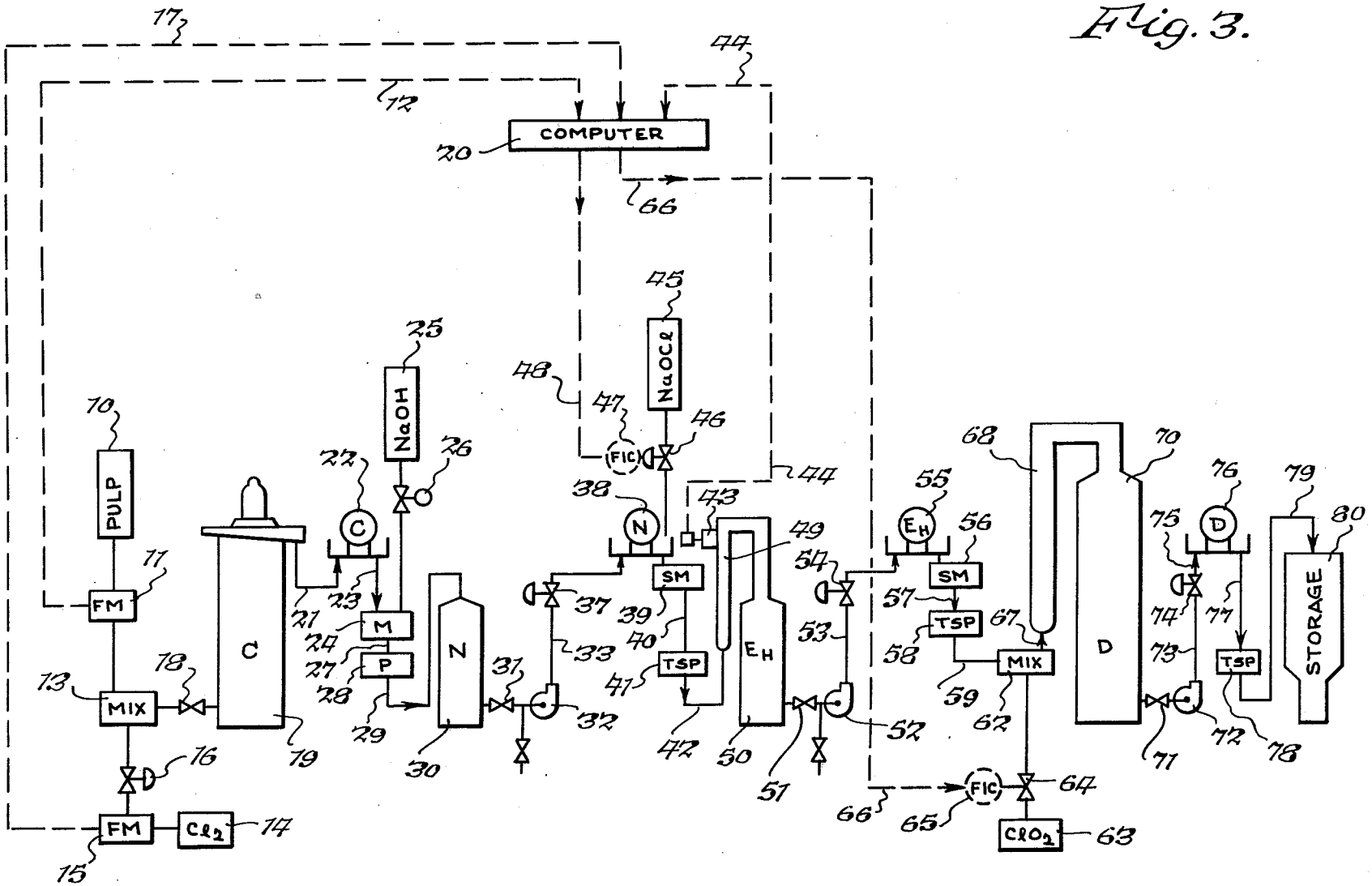
FIG. 3 is a diagrammatic view or flowsheet of a third embodiment of the invention for controlling the bleaching process using the $CNE_HD$ sequence.

The system of the flowsheet of FIG. 3 is another preferred embodiment of the invention, it being the most simplified of the three embodiments and employing a single optical minitoring sensor stationed subsequent to the addition of the hypochlorite. It provides a signal based on a composite function of reflectance at two wavelengths on unwashed hypochlorite treated stock. Since the addition of hypochlorite and thus viscosity control is in the feedback mode it is desirable to have the hypochlorite reaction completed in a short time. This can be achieved by using high temperature. If this were a simple high temperature hypochlorite stage instead of a combined hypochlorite extraction stage the reflectance measurements could be made on either washed or unwashed hypochlorite bleached pulp.

Like parts are numbered identically to those of FIG. 1. It is a prerequisite of the embodiment of FIG. 3 that the amount of chlorine introduced into the pulp be monitored by the computer system as in the embodiment of FIG. 1.

Figure 10:
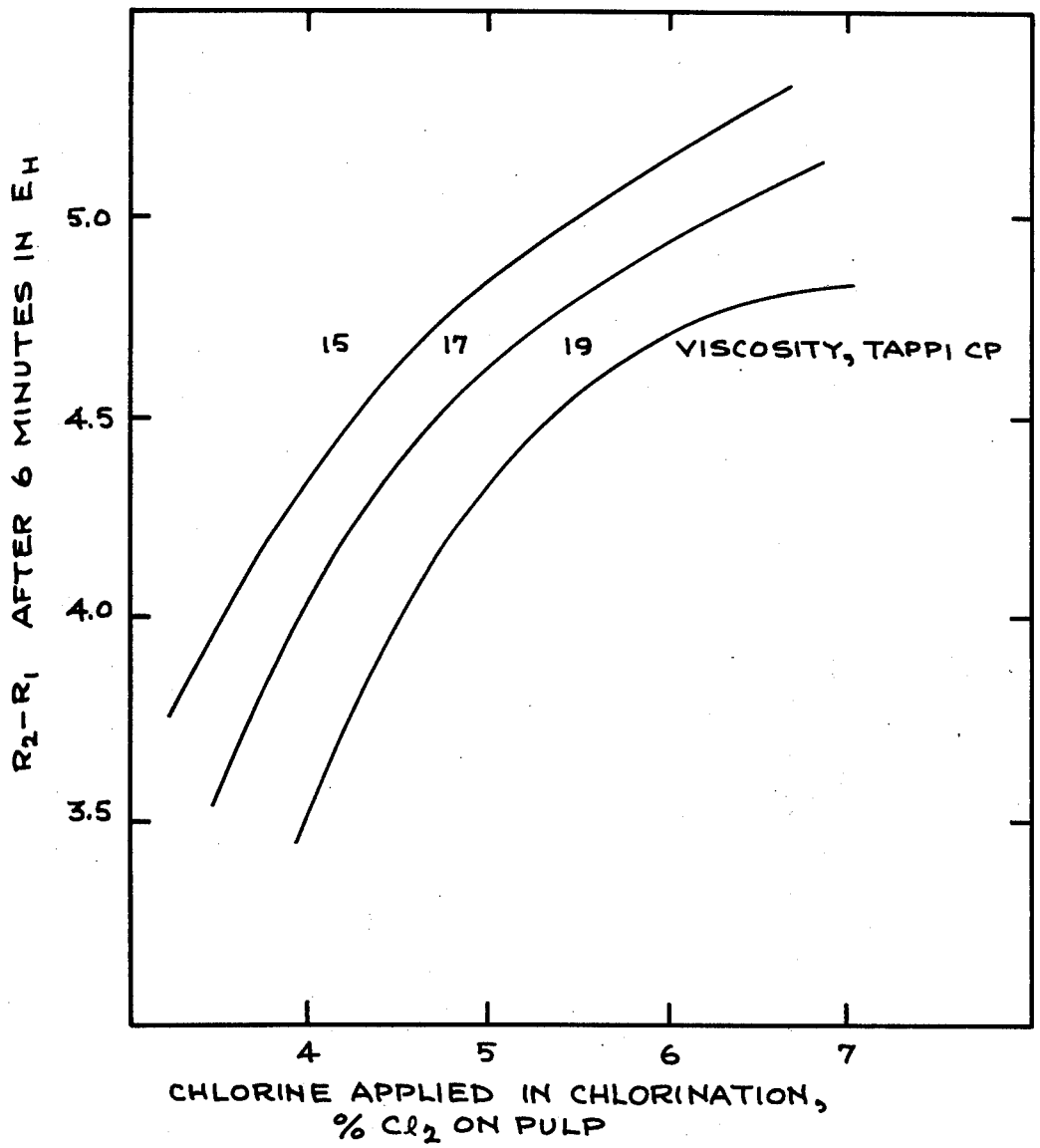
FIG. 10 is a plot of the viscosity contours of fully bleached pulp vs. chlorine applied in chlorination and reflectance values measured 6 minutes after hypochlorite addition in the $E_H$stage of the $CNE_HD$ sequence.

Feedback control of viscosity in the embodiment of FIG. 3 is accomplished by using the relationships shown in FIG. 10. Knowing the percent chlorine applied in the chlorination stage and the required composite function of reflectances leaving the hypochlorite stage to maintain the desired viscosity, the hypochlorite addition is varied to maintain the appropriate composite function of reflectances. This same composite function of reflectances is used to control the chlorine dioxide addition in the final bleach stage to control brightness using the relationships shown in FIG. 11.

In the operation of the system of FIG. 3, pulp (10) is passed through flow meter (11) and the flow regulated with the flow from the flow meter (11) signaled to and controlled by computer (20) through wire (12) and the pulp mixed through mixer (13) with chlorine gas from supply (14) through flow meter (15) and through valve (16). Flow meter (15) has its rate of flow of chlorine signaled to the computer (20) through wire (17). Flow of chlorine is regulated by any reliable control system capable of maintaining a constant degree of chlorination such as that described in U.S. Pat. No. 3,764,463. The mixture of pulp and chlorine from mixer (13) then passes through shutoff valve (18) into chlorination tower (C) (19).

After the chlorination of the pulp, it passes through conduit (21) and is washed over drum washer (C) (22). The washed pulp passes through line 23) into mixer (M) (24) where a solution of sodium hydroxide (25) regulated by valve (26) is mixed with it. Thereafter the mixture of washed chlorinated pulp and sodium hydroxide solution is passed through conduit (27) to pump (P) (28) into line (29) and thence into the tower (N) (30). The neutralized pulp is passed through valve (31) into pump (32) and thence into line (33), through valve (37), onto drum washer (N) (38), where it is mixed with hypochlorite solution from container (45), through valve (46) which is controlled from the computer by flow indicating controller (FIC) (47) through wire (48). The mixture of hypochlorite and pulp is passed through steam mixer (SM) (39), through conduit (40), into thick stock pump (TSP) (41).

After passing out of pump (41) and into pipe (42), the mixture passed through enlarged holding pipe (49), where the reaction with hypochlorite takes place, into tower ($E_H$) (50) where the hot alkaline extraction stage takes place. As it passes through pipe (49), optical monitoring sensor (43) signals through wire (44) to computer (20) the reflectance signal. The pulp then passes through valve (51) and pump (52) into pipe (53) and through valve (54) onto drum washer ($E_H$) (55) where it is washed. The washed pulp is passed into steam mixer (SM) (56) and then through pipe (57) into thick stock pump (TSP) (58). As the pulp leaves pump (58) and as it passes through pipe (59) into mixer (62) where it is mixed with chlorine dioxide from container (63), with the flow of chlorine dioxide being regulated by valve (64) which is regulated by flow controller (FIC) (65), which is in turn controlled by the signal from computer (20) passing through wire (66).

The mixture of pulp and chlorine dioxide then passes through pipe (67) into holding tube (68) and into the reaction tower (D) (70). After reacting with the chlorine dioxide, the pulp is passed out the bottom of tower (70) through valve (71), into pump (72), then into pipe (73), through valve (74) and then by means of pipe (75) onto drum washer (D) (76). It is there washed with water. The washed pulp, having the desired viscosity and brightness, is then passed into pipe (77) and through thick stock pump (TSP) (78) and then through pipe (79) into storage vessel (80).

Figure 4:
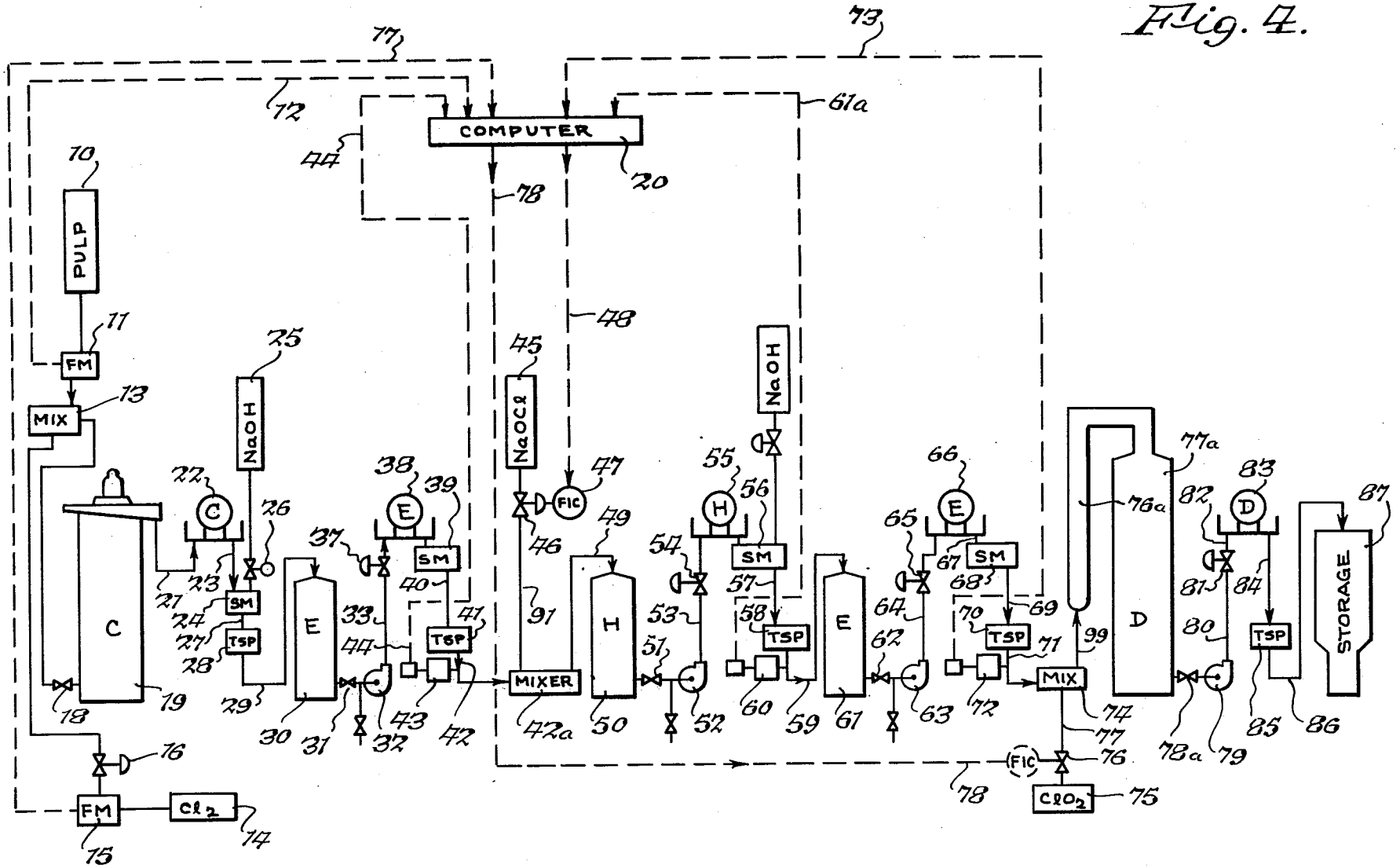
FIG. 4 is a diagrammatic view or flowsheet of one embodiment of the invention for controlling the bleaching process using the CEHED sequence.

The flow sheet of FIG. 4 depicts the operation of the invention for the sequence CEHED. In the operation of the system of FIG. 4, pulp (10) is passed through flow meter (11) and the flow regulated with the flow from the flow meter (11) signaled to and controlled by computer (20) through wire (12) and the pulp mixed through mixer (13) with the chlorine gas from supply (14) through flow meter (15) and through valve (16). Flow meter (15) has its rate of flow of chlorine signaled to the computer (20) through wire (17). Flow of chlorine is regulated by any reliable control system capable of maintaining a constant degree of chlorination such as that described in U.S. Pat. No. 3,764,463. The mixture of pulp and chlorine from mixer (13) then passes through shutoff valve (18) into chlorination tower (C) (19).

After the chlorination of the pulp, it passes through conduit (21) and is washed over drum washer (C) (22). The washed pulp passes through line (23) into steam mixer (SM) (24) where a solution of sodium hydroxide (25) regulated by valve (26) is mixed with it. Thereafter the mixture of washed chlorinated pulp and sodium hydroxide solution is passed through conduit (27) to thick stock pump (TSP) (28) into line (29) and thence into hot alkaline extraction tower (E) (30). The alkaline extracted pulp is passed through valve (31) into pump (32) and thence into line (33), through valve (37), onto drum washer (E) (38). The washed pulp is passed through steam mixer (SM) (39), through conduit (40), into thick stock pump (TSP) (41).

After passing out of pump (41) and into pipe (42), the mixture passes optical monitoring sensor (43) which signals the reflectance signal through wire (44) to computer (20). The pulp then passes into mixer (42*a*) where it is mixed with hypochlorite supplied from container (45) after passing through valve (46). The flow of hypochlorite is regulated by flow controller (FIC) (47) which is in turn controlled by a signal from computer (20) passing through wire (48). The flow of the regulated amount of hypochlorite from flow controller (47) to the mixer (42*a*) is through pipe (91). Upon leaving the mixer (42*a*) the pulp flows through pipe (49) into tower (H) (50). The pulp leaves tower (50) through valve (51) into pump (52), thence through pipe (53), valve (54) onto drum washer (H) (55). After washing on the drum washer (55), the pulp passes into steam mixer (56) where caustic is added, thence through pipe (57) into thick stock pump (TSP) (58) and then into pipe (59). While passing through pipe (59) it is monitored by optical sensor (60) which sends a signal through wire (61*a*) to computer (20). After being monitored by sensor (60), the pulp passes into tower (E) (61), out through valve (62), through pump (63), into pipe (64), through valve (65), onto drum washer (E) (66), where it is again washed. The pulp is then passed via pipe (67) into steam mixer (SM) (68), then into pipe (69) to thick stock pump (TSP) (70) and out into pipe (71). While passing through pipe (71) the pulp is monitored by optical sensor (72) which sends a signal to computer (20) through wire (73). The pulp is then passed to mixer (74) where it is mixed with chlorine dioxide from supply (75) regulated by flow controller (FIC) (76), and flowing into mixer (74) via pipe (77). Flow controller (76) is in turn regulated by the computer (20) by a signal flowing through wire (78).

The mixture of pulp and chlorine dioxide then passes from the mixer (74) into pipe (99) into holding tube (76*a*) and into the reaction tower (D) (77*a*). After reacting with the chlorine dioxide, the pulp is passed out the bottom of tower (77*a*) through valve (78*a*), into pump (79), then into pipe (80), through valve (81), and then by means of pipe (82) onto drum washer (D) (83). It is there washed with water. The washed pulp, having the desired viscosity and brightness, is then passed into pipe (84) and through thick stock pump (TSP) (85) and then through pipe (86) into storage vessel (87).

Figure 5:
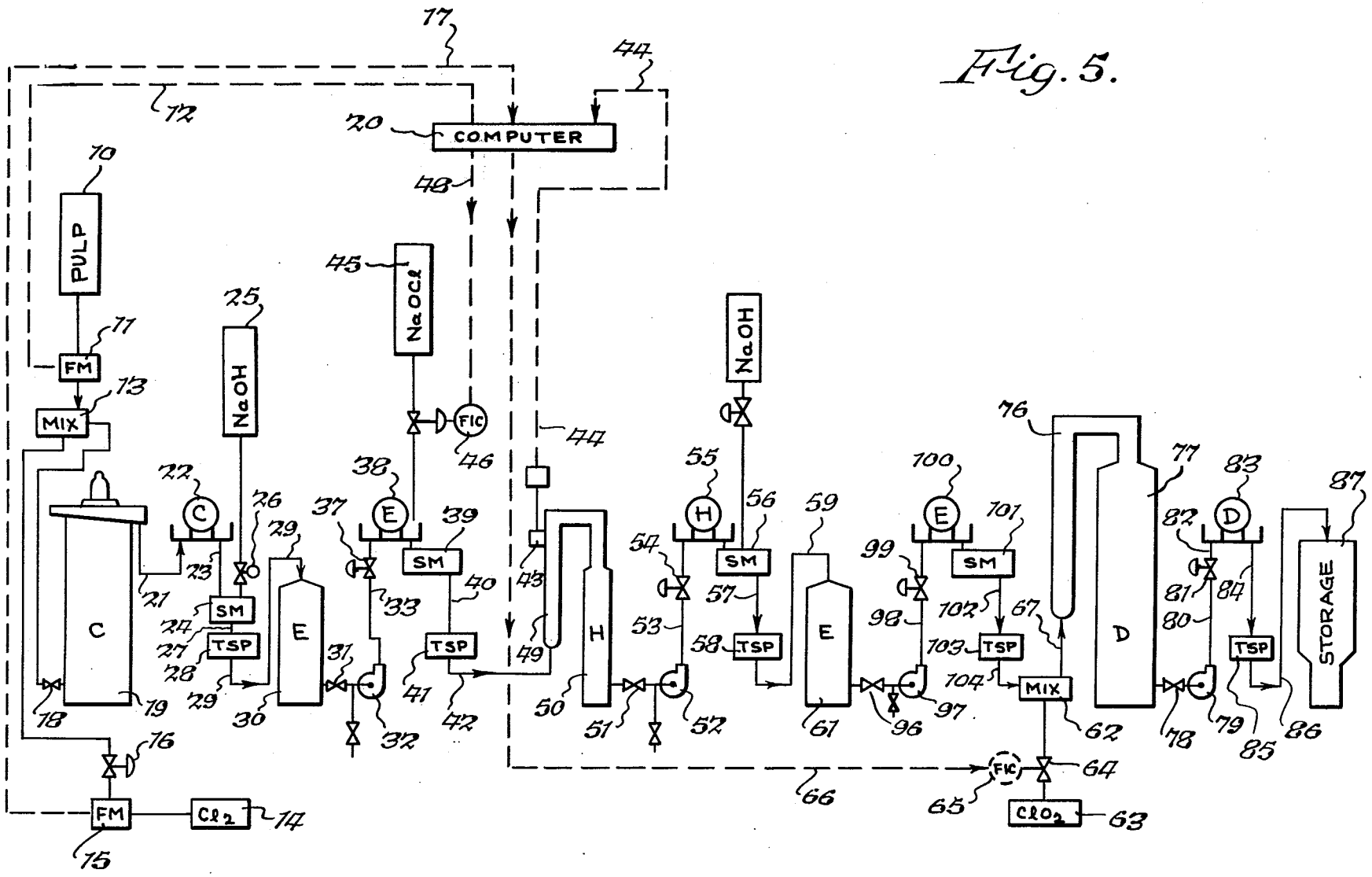
FIG. 5 is a diagrammatic view or flowsheet of another embodiment of the invention for controlling the bleaching process using the CEHED sequence.

The flow sheet of FIG. 5 depicts the operation of the invention for the sequence CEHED. In the operation of the system of FIG. 5, pulp (10) is passed through flow meter (11) and the flow regulated with the flow from the flow meter (11) signaled to and controlled by computer (20) through wire (12) and the pulp mixed through mixer (13) with chlorine gas from supply (14) through flow meter (15) and through valve (16). Flow meter (15) has its rate of flow of chlorine signaled to the computer (20) through wire (17). Flow of chlorine is regulated by any reliable control system capable of maintaining a constant degree of chlorination such as that described in U.S. Pat. No. 3,764,463. The mixture of pulp and chlorine from mixer (13) then passes through shutoff valve (18) into chlorination tower (C) (19).

After the chlorination of the pulp, it passes through conduit (21) and is washed over drum washer (C) (22). The washed pulp passes through line (23) into steam mixer (SM) (24) where a solution of sodium hydroxide (25) regulated by valve (26) is mixed with it. Thereafter the mixture of washed chlorinated pulp and sodium hydroxide solution is passed through conduit (27) to thick stock pump (TSP) (28) into line (29) and thence into hot alkaline extraction tower (E) (30). The alkaline extracted pulp is passed through valve (31) into pump (32) and thence into line (33), through valve (37), onto drum washer (E) (38) where it is mixed with hypochlorite solution from container (45), supplied through flow controller (FIC) (46). Flow controller (46) is actuated by the computer (20) through wire (48). The hypochlorite treated pulp is passed through steam mixer (SM) (39), through conduit (40), into thick stock pump (TSP) (41).

After passing out of pump (41) and into pipe (42), the mixture passes through enlarged holding pipe (49) and thence into tower (H) (50). As it passes through holding pipe (49), optical monitoring sensor (43) signals through wire (44) to computer (20) the reflectance signal. The pulp then passes through valve (51) and pump (52) into pipe (53) and through valve (54) onto drum washer (H) (55) where it is washed. The washed pulp is passed into steam mixer (SM) (56) where caustic is added and then through pipe (57) into thick stock pump (TSP) (58). As the pulp leaves pump (58), it passed through pipe (59) into holding tower (E) (61). After leaving holding tower (61), the pulp passes through valve (96), pump (97) into pipe (98), through valve (99) onto drum washer (100) where it is washed with water. Upon leaving the drum washer (100), the pulp passes into steam mixer (101), through pipe (102) into thick stock pump (103), through pipe (104), into mixer (62) where it is mixed with chlorine dioxide. The chlorine dioxide is supplied from container (63), with the flow of chlorine dioxide being regulated by valve (64) which is regulated by flow controller (FIC) (65), which is in turn controlled by the signal from computer (20) passing through wire (66).

The mixture of pulp and chlorine dioxide then passes from the mixer (62) into pipe (67), into holding tube (76) and into the reaction tower (D) (77). After reacting with the chlorine dioxide, the pulp is passed out the bottom of tower (77) through valve (78), into pump (79), then into pipe (80), through valve (81) and then by means of pipe (82) onto drum washer (D) (83). It is there washed with water. The washed pulp, having the desired viscosity and brightness is then passed into pipe (84) and through thick stock pump (TSP) (85) and then through pipe (86) into storage vessel (87).

The optical monitoring sensors shown at (43) and (60) in FIGS. 1 and 2, at (43) in FIG. 3, at (43), (60) and (72) in FIG. 4 and at (43) in FIG. 5 are instruments such as the "Systematix CST-3 Chromatic Sensor" commercially available from Systematix Inc. As used here they employ light reflectance wavelengths of 580 nanometers and 420 nanometers; other combinations of wavebands may also be used. Such a device is illustrated at FIG. 2 of Strom et al. U.S. Pat. No. 3,465,550 the dual waveband monitoring sensor of the Systematix type may be replaced by single waveband monitoring sensors such as those of the Britel type. For best results, it is desirable that the monitoring sensor employed at reference numeral (43) in the flow sheets of FIGS. 1 through 5 be of the dual waveband type, such as that of Systematix. These in-line sensors are desirably employed as shown in FIGS. 1 and 2 of U.S. Pat. No. 3,764,463. These sensors direct a signal to the computer or other regulator which is programmed in accordance with the usual computer techniques to control the flow of the desired bleaching agents at the proper stages of the bleaching process.

The method and apparatus of the present invention are made possible by the discovery that there is a definite relationship between viscosity contours and brightness values on one hand and the reflectance measurements made on pulp undergoing bleaching before and/or after the hypochlorite stage.

Figure 6:
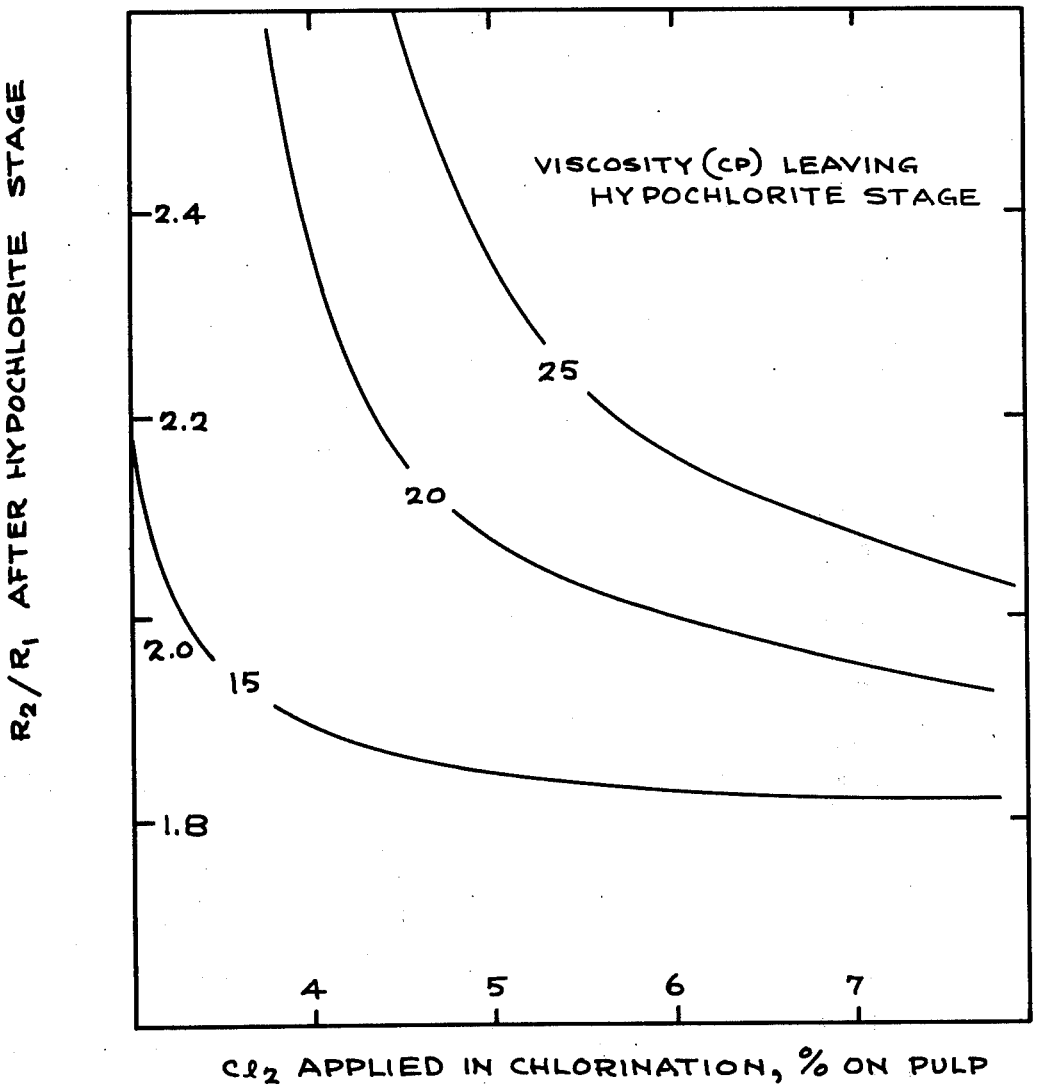
FIG. 6 is a graphical representation of hypochlorite stage viscosity contours versus chlorine applied for chlorination and the ratio of reflectance values at two wavelengths ($R_2/R_1$) after the hypochlorite stage in a $CNE_HD$ bleaching sequence.

FIG. 6 shows a plot of viscosity contours vs. chlorine applied under controlled chlorination conditions and reflectance measurements of a pulp after the hypochlorite bleach stage. The graph of this figure shows that in order to maintain a constant viscosity (a specification of the pulp grade), it is necessary to vary the target reflectance of the hypochlorite bleached pulp depending on the precent chlorine in the chlorination stage.

Figure 7:
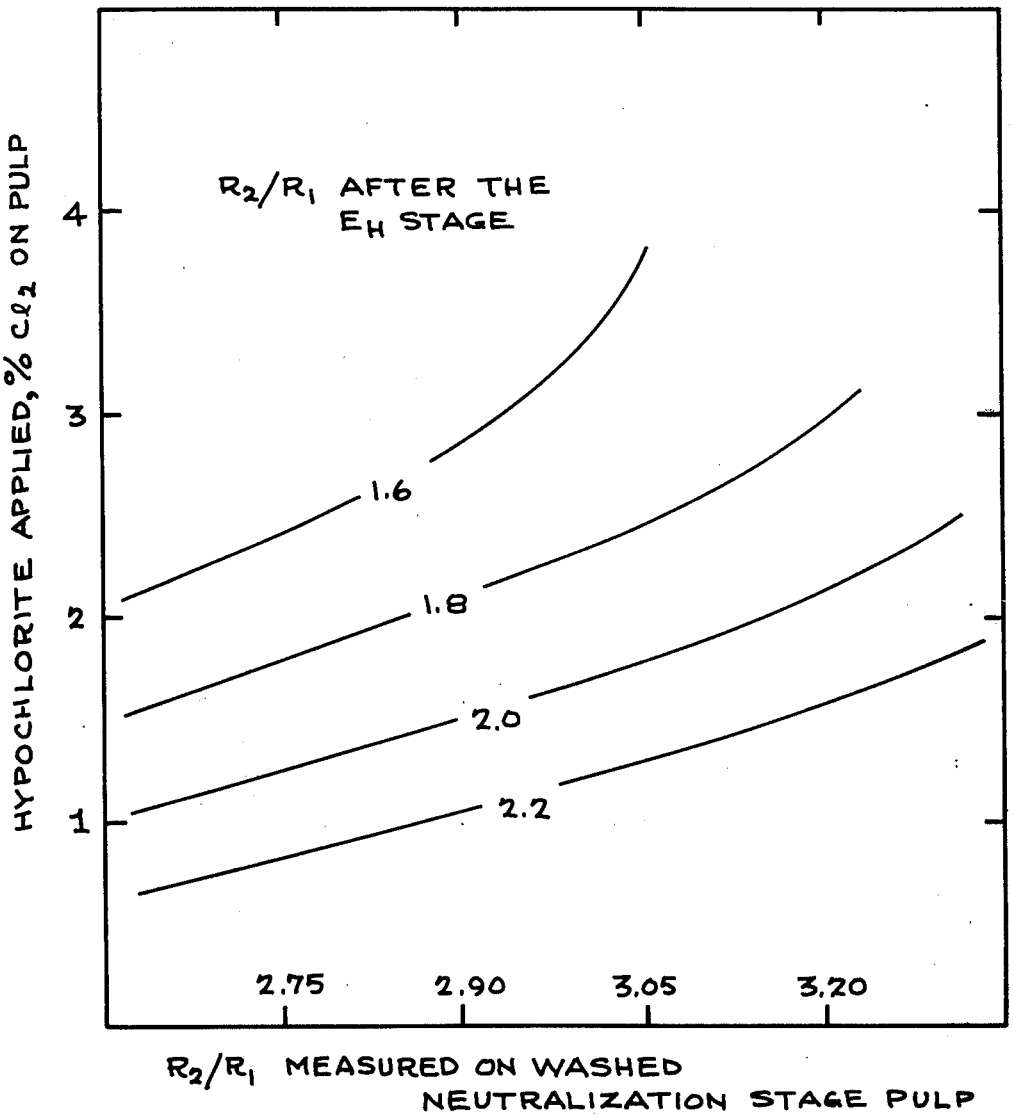
FIG. 7 is a graphical representation of reflectance contours, $R_2/R_1$ after the hypochlorite stage, versus reflectance values measured on washed neutralization stage pulp and hypochlorite applied in the hypochlorite stage of the $CNE_HD$ sequence. The contours of FIG. 7 represent the ordinate of FIG. 6.

The graph of FIG. 7 shows a relationship between the composite function of two reflectance measurements taken on the neutralized pulp by optical monitoring sensor (43) shown on the flow sheet of FIG. 1 and the amount of hypochlorite required to reach various reflectance levels at the end of the hypochlorite stage represented by the contours of FIG. 7.

The information on pulp flow and chlorine flow (% $Cl_2$ on pulp) at the chlorination stage is stored in the computer to compensate for the time during which the pulp is in the chlorination and neutralization stage towers. This information determines the target reflectances for the hypochlorite stage to achieve the desired viscosity according to FIG. 6. Using the relationships of FIG. 7, the reading at sensor (43) of the flowsheet of FIG. 1 shows how much hypochlorite to apply to order to obtain the desired reflectance at optical monitoring sensor (60) of FIG. 1. Sensor (60) of FIG. 1 measures the actual reflectance obtained from hypochlorite addition under feed forward control from sensor (43) and the relationship of FIG. 7. Sensor (60) may then be used to adjust the relationships of FIG. 7 so that target and actual reflectances are the same; these relationships may be affected by variations in washing efficiency, changes in wood supply etc.

Figure 8:
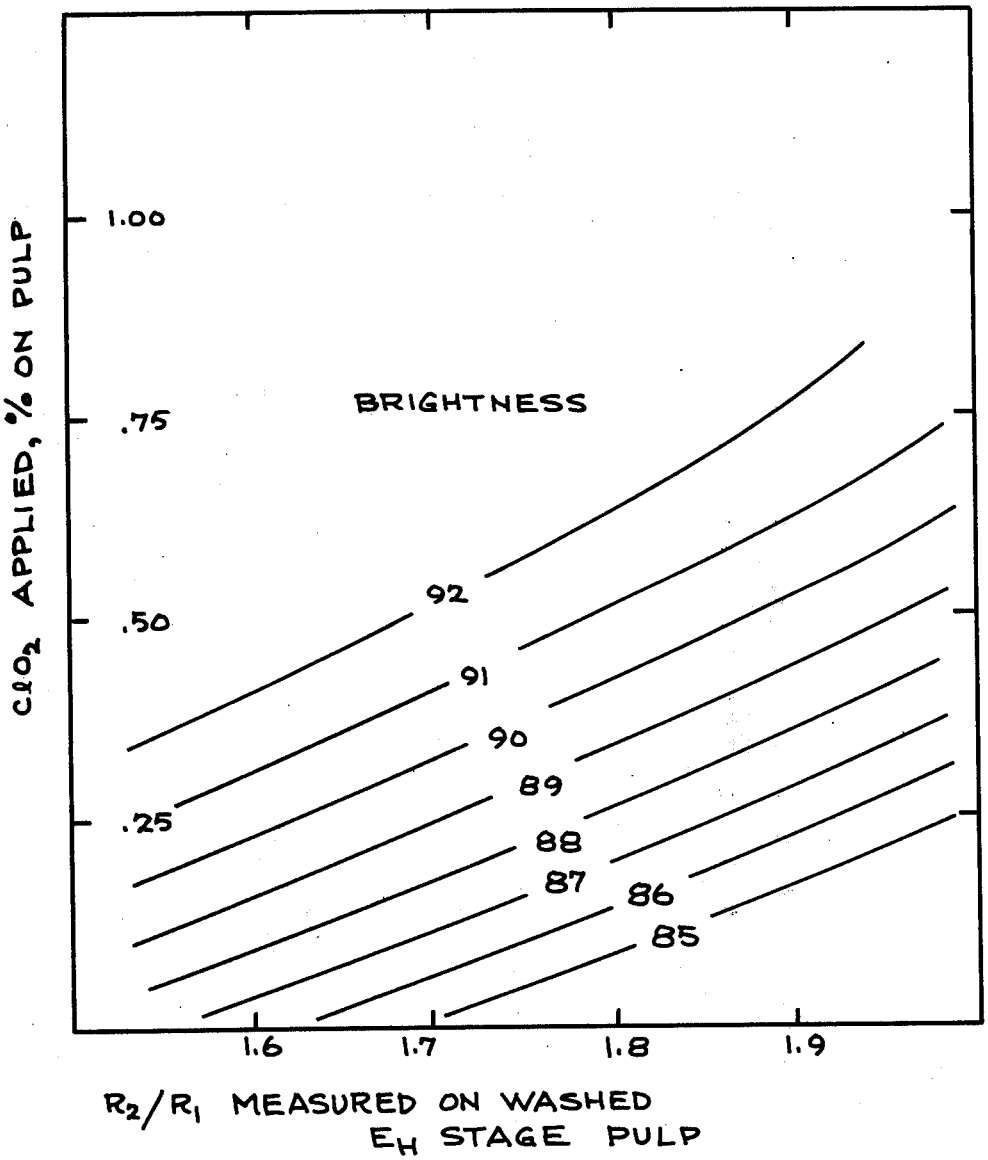
FIG. 8 is a graphical representation of the relation of the ratio of reflectance values measured after the hypochlorite stage and the application of chlorine dioxide to give a variety of final brightness levels for pulp bleached by a $CNE_HD$ bleaching sequence.

The data contained in FIG. 8 is typical of that used to control the fully bleached brightness at any desired level from 85 to 92 Elrepho. Sensor (60) of the flowsheet of FIG. 1 measures the composite function of optical readings. Knowing the desired target brightness level, the computer applies the correct amount of chlorine dioxide according to the relationships of FIG. 8, as established for the particular system.

In summary, the flowsheet of FIG. 1 operates by controlling the hypochlorite addition according to the % chlorine on pulp applied for chlorination and the optical signal from sensor (43) in order to control viscosity using the relationships established in FIGS. 6 and 7. Sensor (60) updates the program for sensor (43) and also controls the chlorine dioxide addition to achieve the final target brightness according to the relationships of FIG. 8.

Figure 9:
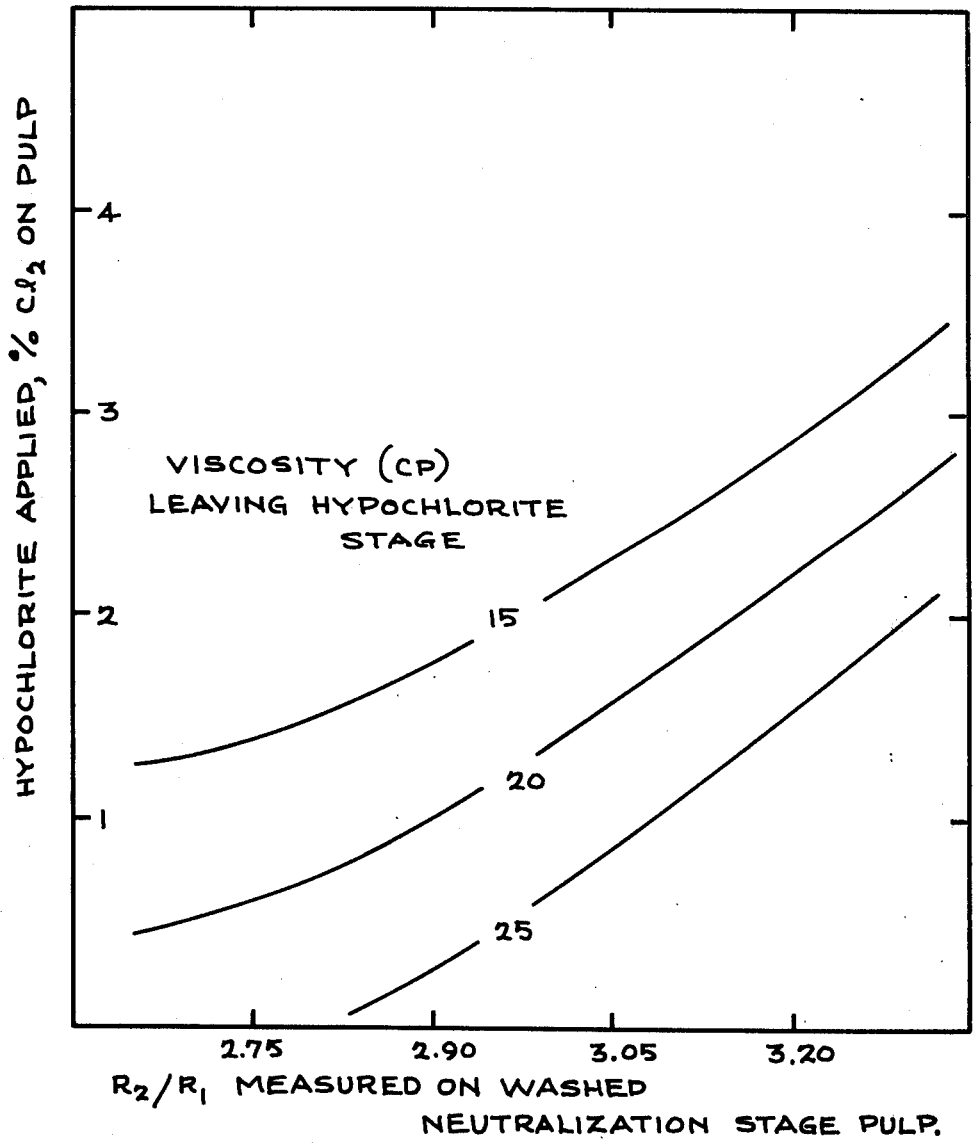
FIG. 9 is a graphical representation of the relation of viscosity of pulp in a bleaching process compared to the reflectance values after the neutralization stage and the amounts of hypochlorite employed in a $CNE_HD$ bleaching sequence.

In the system of the flowsheet of FIG. 2, the reflectance optical monitoring sensors (43) and (60) can be mounted as shown in the figure or on the drum washers (N) (38) and ($E_H$) (55), respectively. The sensor (43) provides a reading of the composite function of reflectances at two wavelengths. The computer utilizes the relationships established by the graph of FIG. 9, to control the hypochlorite addition and thus regulate and control the pulp viscosity. FIG. 9 is a graph setting forth the relationship of viscosity contours versus reflectance values for certain amounts of hypochlorite added. Sensor (60) provides a signal based on the composite function of reflectances at two wavelengths on washed stock from the hypochlorite stage. The relationships established in the graph of FIG. 8 are employed in the composite to control the chlorine dioxide addition as in the system of the flowsheet of FIG. 1.

The correlations of FIGS. 6, 7 and 9 were obtained from the first three stages of the $CNE_HD$ sequence. The correlation of FIG. 8 was obtained from the last two stages of the $CNE_HD$ sequence. The values of "$R_2/R_1$" in FIGS. 6 through 9 were obtained with the Systematix CST-3 chromatic sensor, employing light reflectance wavelengths of 580 nanometers and 420 nanometers. The expression "$R_2/R_1$" is the ratio of the two reflectance values where $R_2 = 580$ and $R_1 = 420$ nanometers.

In obtaining the correlation of FIG. 6 the Systematix sensor instrument was positioned at reference numeral (60) as in the flowsheet of FIG. 1. The two Systematix sensor instruments in obtaining the correlation of FIG. 7 were positioned as at reference numerals (43) and (60) in the flowsheet of FIG. 1. In obtaining the correlation of FIG. 8, the Systematix sensor was positioned as at (60) in the flowsheet of FIGS. 1 and 2. In obtaining the correlation of FIG. 9 the Systematix instrument was positioned as at reference numeral (43) in the flowsheet of FIG. 2. In obtaining the correlations of FIGS. 10 and 11, the Systematix sensor was positioned as at (43) in the flowsheet of FIG. 3.

Further details as to how the correlations were obtained will be described in the examples which will appear hereinbelow.

The computer programs of the control systems of all embodiments would be updated from time to time based on actual viscosity tests measured either on the fully bleached pulp or on the pulp leaving the hypochlorite stage. Such updating would likely be necessitated by gradual drifts in the calibration of measuring instruments such as flow meters or optical instruments or by changes in wood supply or cooking variables.

It is, of course, within the skill of those reasonably versed in computer operation to program the computer to respond to the correlations provided.

In order to disclose more clearly the nature of the present invention, the following examples, depicting operations under the flowsheets of FIGS. 1 thru 5 of the drawings, illustrating the invention are given. It should be understood, however, that that is done solely by way of example and is intended neither to delineate the scope of the invention nor limit the ambit of the appended claims.

EXAMPLE 1

In this example, the operations and system are those of the flowsheet of FIG. 1 of the drawings and the foregoing discussion of that flowsheet.

A sample of eastern Canadian softwood chips was cooked by the kraft process to four different levels of cooking degree which covered the screenable range from Kappa No. 19 to Kappa No. 37. The viscosities of these unbleached pulps ranged from 23.7 to 41.6 cp (Tappi Test T-230). These pulps were then bleached by the $C_DNE_HD$ bleach sequence where:

$C_D$ = chlorination with chlorine plus 0.1% $ClO_2$ on pulp

N = neutralization with caustic at low consistency and low temperature $E_H$ = high temperature caustic extraction to which sodium hypochlorite is added D = high temperature chlorine dioxide bleach stage.

The appropriate amount of chlorine for chlorination of each of the pulps was selected on the basis of optical measurements made on pulps chlorinated at 70° C. to simulate off line control as described in U.S. Pat. No. 3,764,463. A series of trail chlorinations with various levels of chlorine addition were run at this temperature and optical readings were taken after 3 minutes using a Systematix CST-3 chromatic sensor. By interpolation from plots of chlorine applied vs. the optical reading the appropriate amount of chlorine for each sample was selected to give a fixed optical reading which was representative of adequate chlorination.

The main body of each of the cooks were chlorinated at 3% consistency for 1 hour at 25° C., using the amount of chlorine indicated by the optical measurements on the trial chlorinations. Each chlorinated pulp was washed then neutralized at 3% consistency for 30 minutes at 25° C. Caustic for the neutralization was applied according to the equation: NaOH, % on pulp = $0.19 \times$ % $Cl_2$ applied in chlorination + 0.57

The neutralization stage pulps were washed and optical measurements were taken with the Systematix CST-3 on 12% slurries of the pulps in water. Each neutralization stage pulp was then subdivided into three portions and bleached with appropriate amounts of hypochlorite to give a range of brightnesses and viscosities leaving the hypochlorite extraction stage. Conditions for this stage were 11% consistency at 82° C. for 1 hour with 2.3% NaOH applied. Each of the 12 hypochlorite-extraction stage pulps was washed and subjected to further optical readings using the Systematix CST-3 instrument. The hypochlorite-extraction stage pulps were then subdivided and bleached at 10% consistency and 80° C. for varying times with varying amounts of chlorine doxide applied in order to obtain a range of fully bleached brightnesses.

Data on chlorine applied for chlorination, optical measurements after the neutralization and hypochlorite extraction stages, amounts of hypochlorite and chlorine dioxide applied in the $E_H$ and D stages were subjected to regression analysis by computer. The relationships shown in FIGS. 6 to 9 were obtained based on these data.

The relationship shown in FIGS. 6 and 7 are then combined to show the general strategy for viscosity control as depicted in the flowsheet of FIG. 1. FIG. 6 shows contours of constant viscosity after the hypochlorite stage plotted against chlorine applied for chlorination and an optical reading of the washed hypochlorite bleached pulp. Therefore, if the chlorine applied in the chlorination stage and the desired target viscosity are known the target optical reading of the pulp after hypochlorite bleaching can be read from FIG. 6. Contours of this optical reading on hypochlorite bleached pulp are plotted against an optical reading on the neutralization stage pulp and the hypochlorite applied in the hypochlorite stage as shown in FIG. 7. Knowing the optical reading of the neutralization stage pulp and the desired optical reading after hypochlorite bleaching, the proper hypochlorite application is read from the graph of FIG. 7.

The optical reading measured on the hypochlorite bleached pulp may be used to update the control program obtained from FIG. 7 and is also used to determine the chlorine dioxide application for the chlorine dioxide bleach stage by making use of the relationships shown in FIG. 8.

EXAMPLE 2

In this example the operations and system are those of the flowsheet of FIG. 2 of the drawings and the foregoing discussion of that flowsheet.

The more direct viscosity control process shown in flowsheet 2 was established with the particular pulp and bleach sequence used in Example 1, using the relationship between viscosity, hypochlorite applied and an optical measurement on the washed neutralization stage pulp as shown in FIG. 9. A second optical measurement on the hypochlorite bleached pulp was then used to control the chlorine dioxide applied to obtain the desired fully bleached brightness using the relationships of FIG. 8. The method of viscosity and brightness control was tested on a series of unkown pulps as described below.

A series of 8 pulps from the same wood supply as described in Example 1 was cooked by the kraft process. These pulps covered a wide range of unbleached Kappa No. and viscosity as shown in Table I, below. The pulps were chlorinated and neutralized as described in Example 1 and optical measurements were made on the washed neutralization stage pulps. The appropriate hyprochlorite addition to give the desired target viscosity was read from FIG. 9 and the pulp was hypochlorite bleached using the conditions for the $E_H$ stage used in Example 1. The hypochlorite bleached pulp was washed and an optical measurement was made on this pulp. From the relationships of FIG. 8, this optical measurement was used to determine the chlorine dioxide application for the chlorine dioxide bleach stage to give the desired final brightness. The pulps were then chlorine dioxide bleached according to the conditions given in Example 1. Table I shows that despite a variation in unbleached viscosity from 22.6 to 42.4 cp. the fully bleached viscosity varied only from 16.1 to 17.2 cp. and the fully bleached brightness varied only from 91.7 to 92.5. Note the wide variation in th $E_H$ stage brightness resulting from viscosity control.

TABLE 1

| Unbleached Pulp | | $E_H$ Stage | Fully Bleached Pulp | |
|---|---|---|---|---|
| Kappa No. | Viscosity Tappi Test T-230 (cp) | Brightness | Brightness Elrepho | Viscosity T-230 cp |
| 19.0 | 22.6 | 64.5 | 91.7 | 16.6 |
| 22.2 | 28.5 | 67.1 | 92.1 | 16.1 |
| 23.7 | 29.9 | 67.7 | 92.5 | 16.7 |
| 26.0 | 33.1 | 68.7 | 92.3 | 17.1 |
| 26.4 | 31.8 | 68.7 | 91.9 | 16.3 |
| 31.9 | 35.7 | 68.0 | 92.4 | 17.2 |
| 33.5 | 39.5 | 69.8 | 92.3 | 16.3 |
| 34.5 | 42.4 | 70.5 | 92.3 | 16.2 |

EXAMPLE 3

A similar procedure to that described in Example 1 but using the control system described in the flowsheet of FIG. 3 was run using eastern Canadian softwood kraft pulp. Instead of measuring the optical properties of washed pulps after both the neutralization and hypochlorite stages the optical properties were measured on unwashed pulp after 6 minutes bleaching at 82° C. in the hypochlorite extraction stage. This one signal used to control both hypochlorite and $ClO_2$ thus replaced the two optical signals used in the general control system of FIG. 1.

Figure 11:
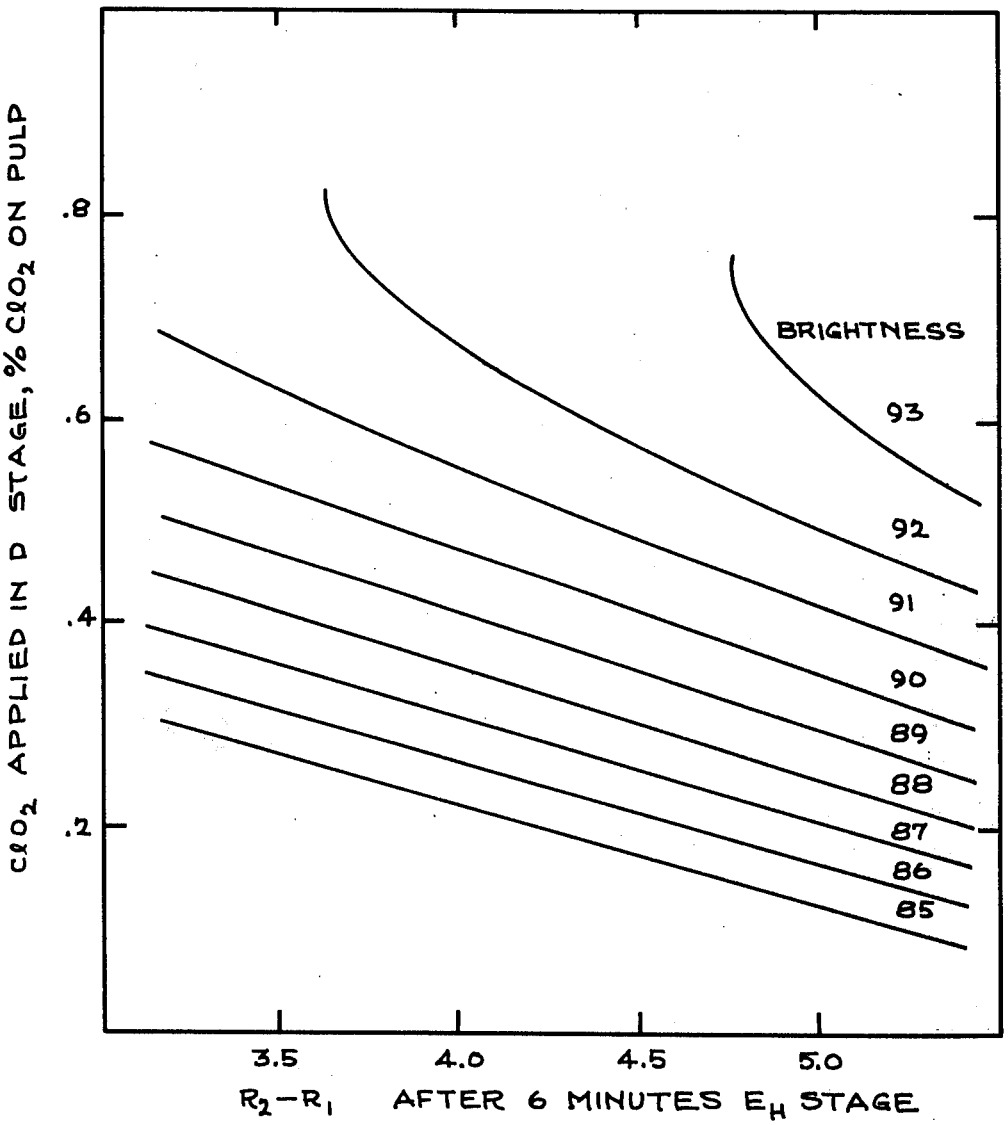
FIG. 11 is a plot of the contours of fully bleached brightness vs. reflectance values measured after 6 minutes of the $E_H$ stage and $ClO_2$ applied in the final stage of the $CNE_HD$ sequence.

The relationships shown in FIG. 10 would be used in a continuous process to feed back control the viscosity of fully bleached pulp while the relationships shown in FIG. 11 would be used to feed forward control the fully bleached brightness.

EXAMPLE 4

This example describes the development of control curves for the $C_DEHED$ sequence which are similar to those described in Examples 1 and 3. Flowsheets are shown in FIGS. 4 and 5.

A sample of western Canadian softwoods was cooked by the kraft process to four different levels of cooking degree which covered the screenable range from Kappa No. 21 to Kappa No. 42. The viscosity of these unbleached pulps ranged from 26.5 cp to 36.2 cp (Tappi Test T-230). These pulps were bleached by the $C_DEHED$ sequence where:

$C_D$ = chlorination with chlorine plus 0.1% $ClO_2$ on pulp

E = a hot alkaline extraction stage

H = a conventional low temperature hypochlorite stage

D = a high temperature chlorine dioxide bleach stage.

The appropriate amount of chlorine for chlorination of each of the pulps was selected on the basis of optical measurements similar to those described in Example 1.

The main portion of each of the cooks was chlorinated at 3.5% consistency, for 50 minutes at 30° C. Caustic for application in the first extraction stage was applied according to the equation. NaOH, % on pulp = 0.225 × % $Cl_2$ applied in chlorination + 1.146

The extraction stage pulps were washed and optical measurements were taken on slurries of the pulps at 12% consistency. Each extraction stage pulp was subdivided into 3 portions and bleached with appropriate amounts of sodium hypochlorite to give a wide range of brightnesses and viscosities leaving the hypochlorite stage. Hypochlorite stage conditions were 11% consistency, 50° C., time was varied to give a hypochlorite residual of 0.05% $Cl_2$ on pulp. Optical measurements were made on pulp slurries both before and after washing. The pulps were then subjected to a standard second extraction stage at 11% consistency and 80° C. for 1 hour with 0.6% NaOH applied on pulp. The pulp was washed and optical measurements were made on a slurry of the washed pulps at 12% consistency. The pulps were then further subdivided and bleached at 11% consistency and 85° C. with several levels of chlorine dioxide in order to obtain a wide range of fully bleached brightnesses.

Data on chlorine applied for chlorination, optical measurments after the first and second hot caustic extraction stages and after the hypochlorite stage, amounts of hypochlorite consumed and chlorine dioxide applied in the H and D stages respectively, and brightness and viscosity data from the final bleach stage were subjected to regression analysis by computer. The relationships shown in FIGS. 12, 13, 14, 15 and 16 were obtained based on these data.

a. A General Control Strategy

Figure 12:
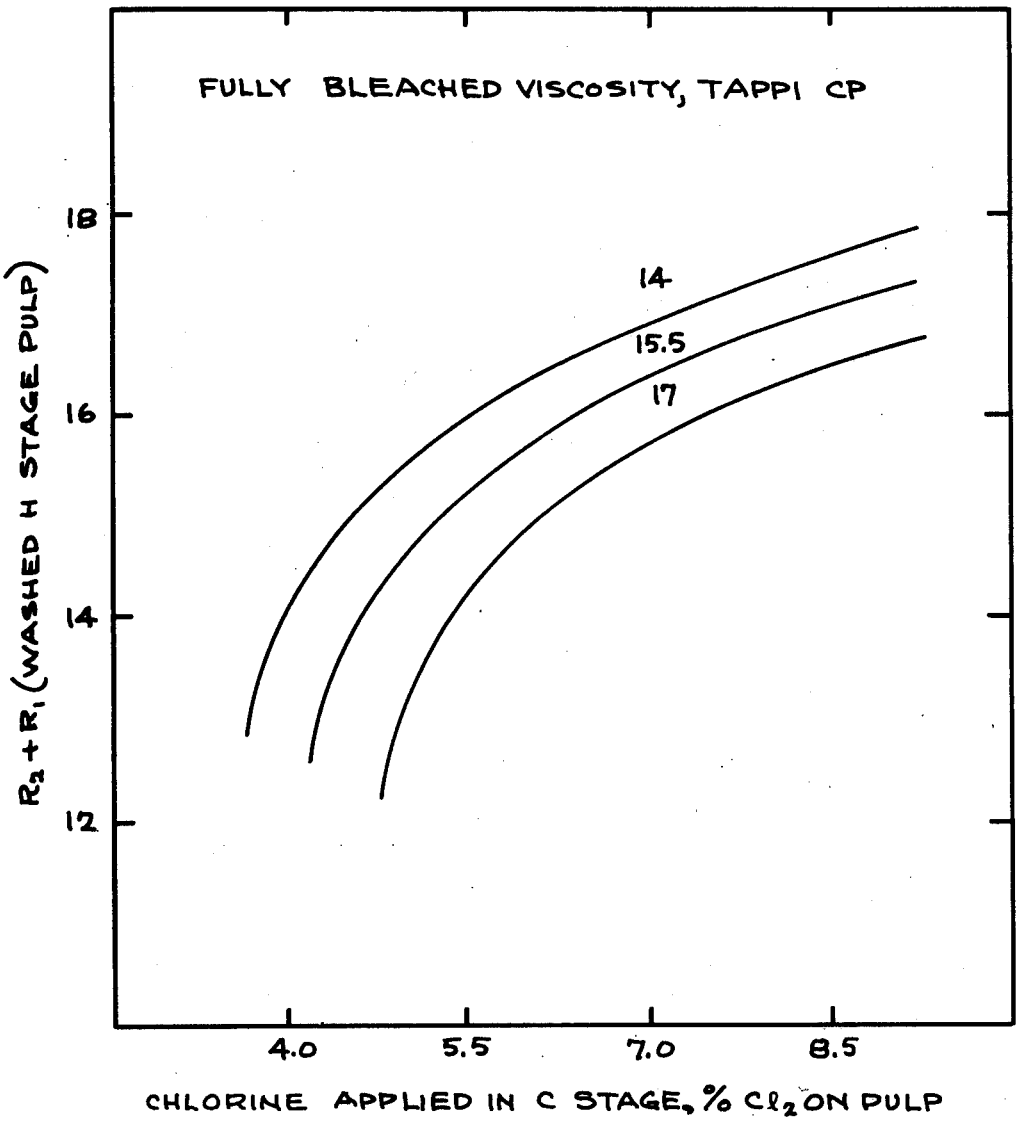
FIG. 12 is a plot of the viscosity contours of fully bleached pulp vs. chlorine applied in chlorination and reflectance values after hypochlorite bleaching in the CEHED sequence.
Figure 13:
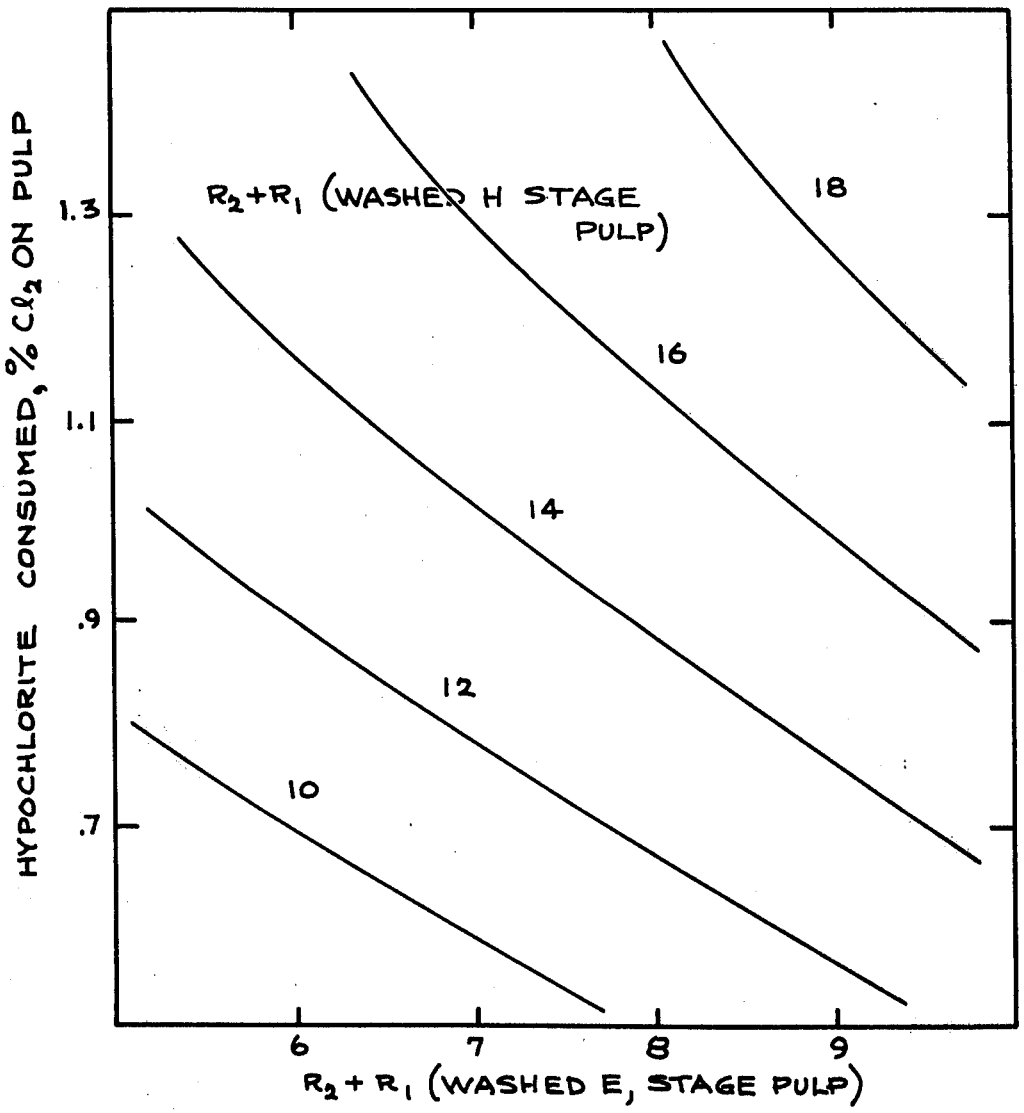
FIG. 13 is a plot of the reflectance contours after hypochlorite bleaching vs. reflectance values after the first extraction stage and hypochlorite consumed in the H stage of the CEHED sequence. The contours of FIG. 13 represent the ordinate of FIG. 12.
Figure 14:
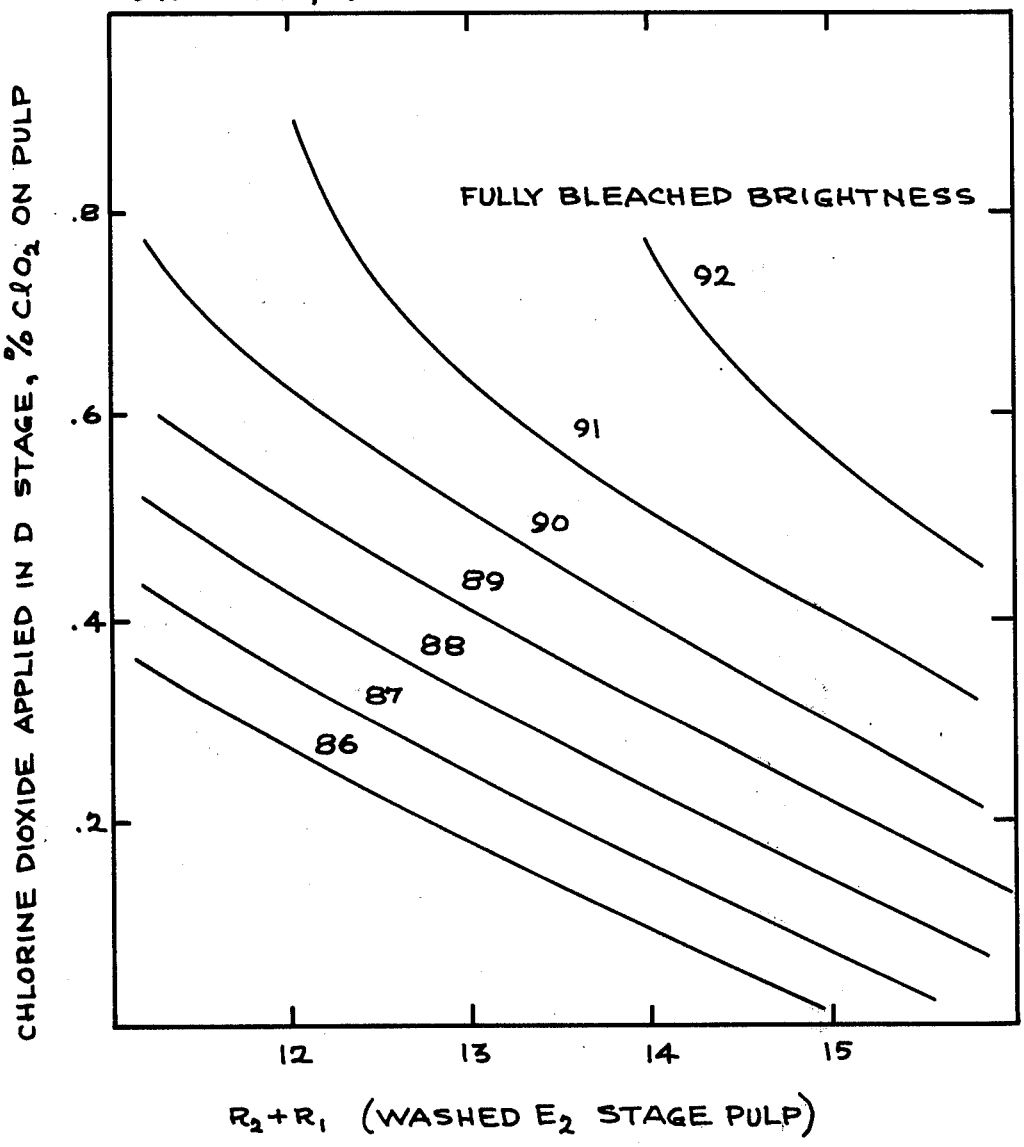
FIG. 14 is a plot of the contours of fully bleached brightness vs. reflectance values after the second extraction stage and chlorine dioxide applied in the final bleach stage of the CEHED sequence.

As in this example, the relationships shown in FIGS. 12 and 13 can be combined to provide feed forward viscosity control of the fully bleached pulp based on knowledge of the chlorine applied for chlorination and optical measurements made on the wshed first extraction stage pulp and the washed hypochlorite stage pulp. Feed forward control of the fully bleached brightness can be obtained based on knowledge of the optical properties measured on washed pulp after the second extraction stage by using the relationships shown in FIG. 14.

b. A Simplified Control Strategy

Figure 15:
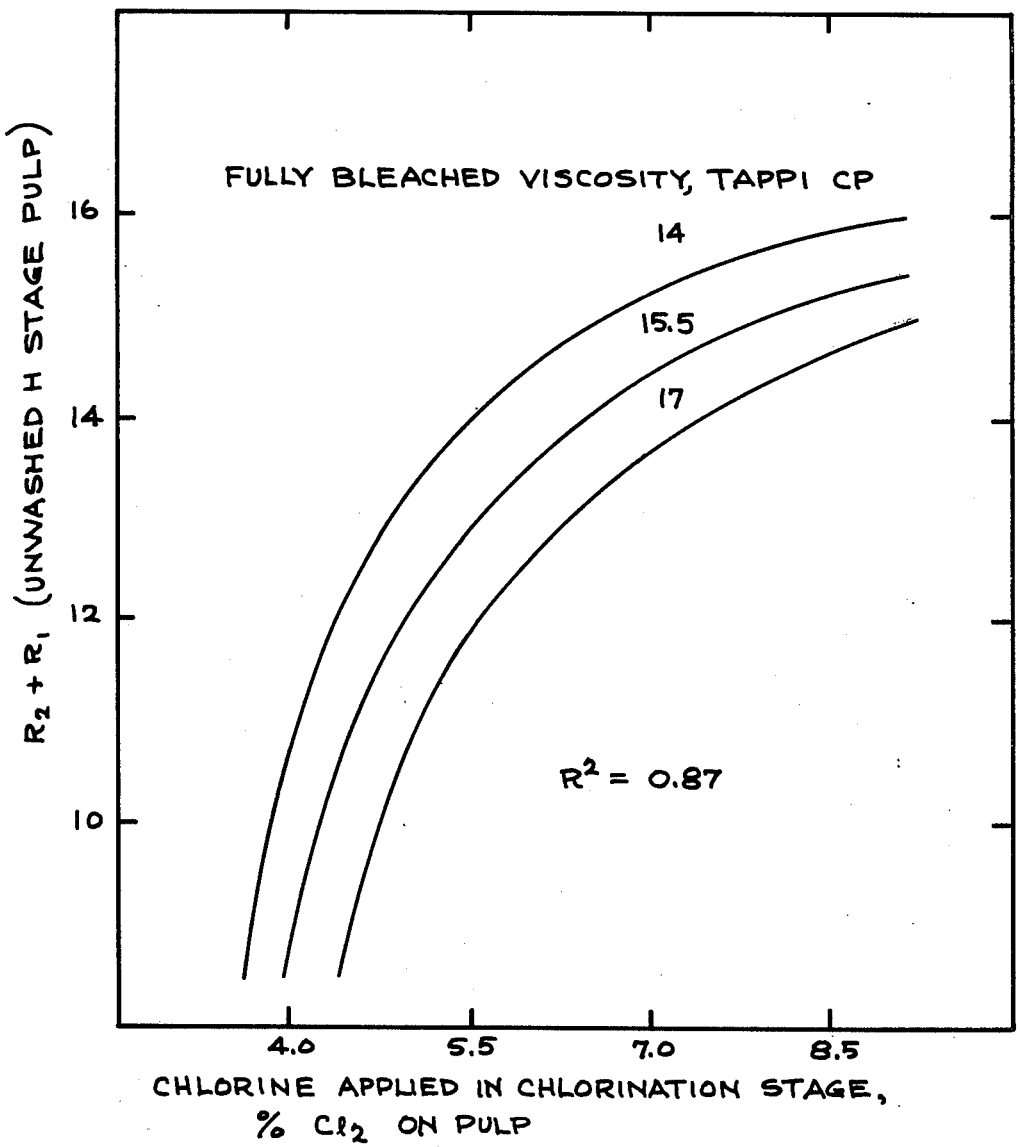
FIG. 15 is a plot of the viscosity contours of fully bleached pulp vs. chlorine applied in chlorination and reflectance on unwashed hypochlorite bleached pulp from the CEHED sequence.
Figure 16:
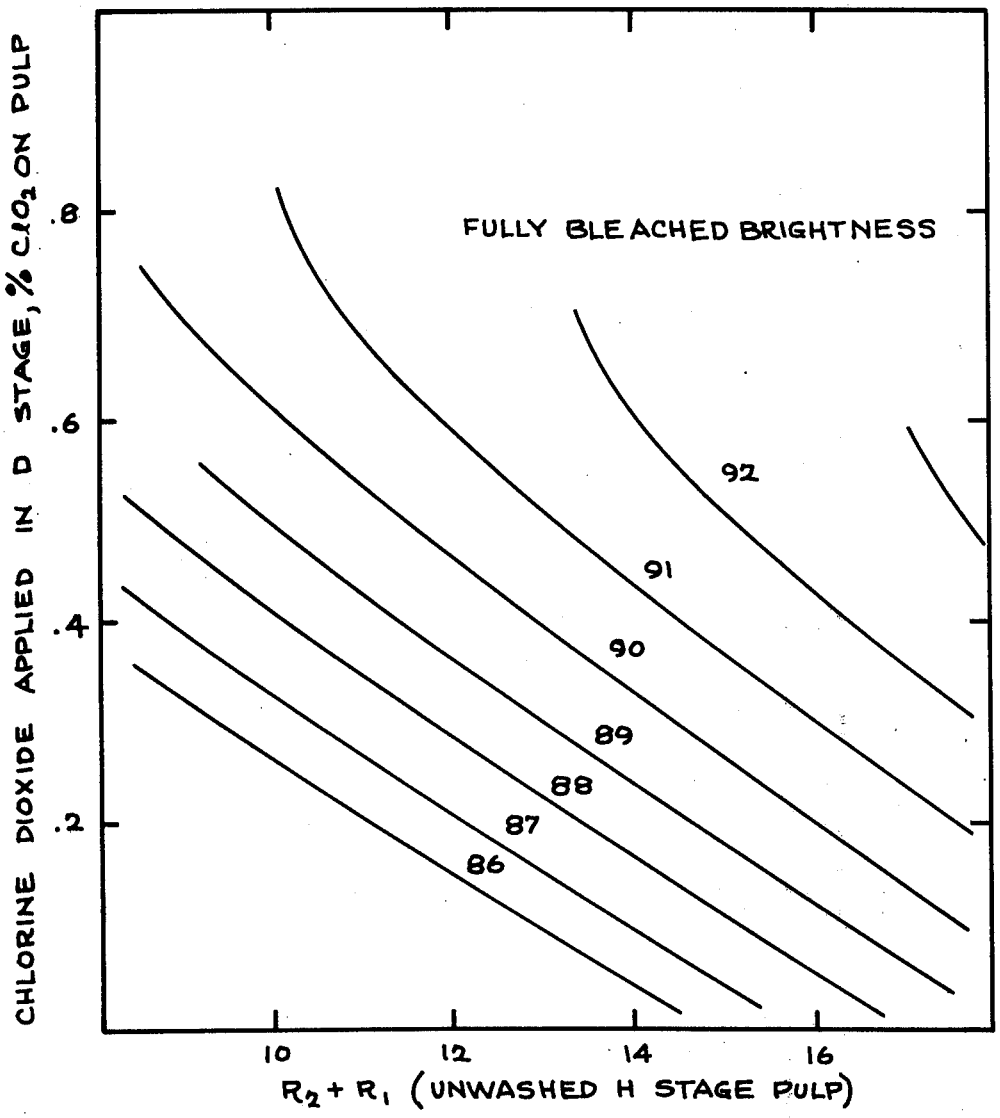
FIG. 16 is a plot of the contours of fully bleached brightness vs. reflectance values measured on unwashed H stage pulp and chlorine dioxide applied in the final bleach stage of the CEHED sequence.

Provided the hypochlorite stage reaction can be speeded up, as would be possible by increasing the temperature of the stage, the applications of both hypochlorite and chlorine dioxide can be controlled for these respective stages in this example by a single optical measurement made on unwashed hypochlorite bleached pulp using the relationship in FIG. 15 for feedback control of hypochlorite addition and FIG. 16 for feed forward control of chlorine dioxide addition. Such a method of hypochlorite stage control makes high temperature (80° C.) hypochlorite bleaching practical. High temperature hypochlorite bleaching is an essential element of water reduction and pollution abatement by means of countercurrent washing in bleacheries which have a hypochlorite stage in their bleach sequence.

EXAMPLE *5a*

Figure 17:
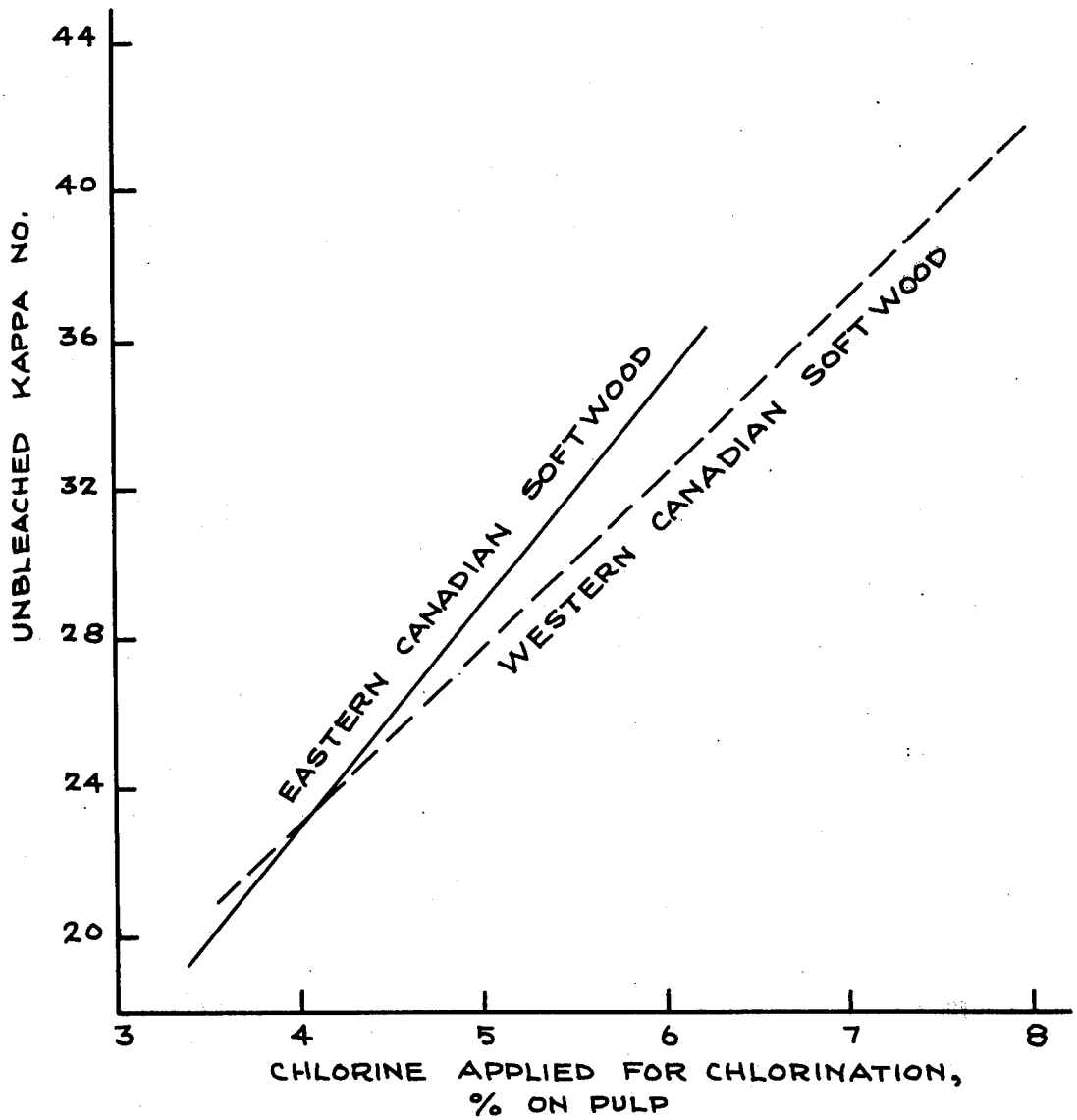
FIG. 17 is a plot of the correlation between chlorine applied for chlorination and Kappa No. of the unbleached pulp for two types of softwood kraft pulp.

FIG. 17 shows that there is a correlation between the percent chlorine applied for chlorination and unbleached Kappa No. Use can be made of this relationship to operate control systems similar to those in Examples 1, 3 and 4 in which the on-line signals of pulp flow and chlorine flow are replaced by a manual entry of unbleached Kappa No. Otherwise the control systems would be identical to those described in Examples 1, 3 and 4.

EXAMPLE *5b*

Figure 18:
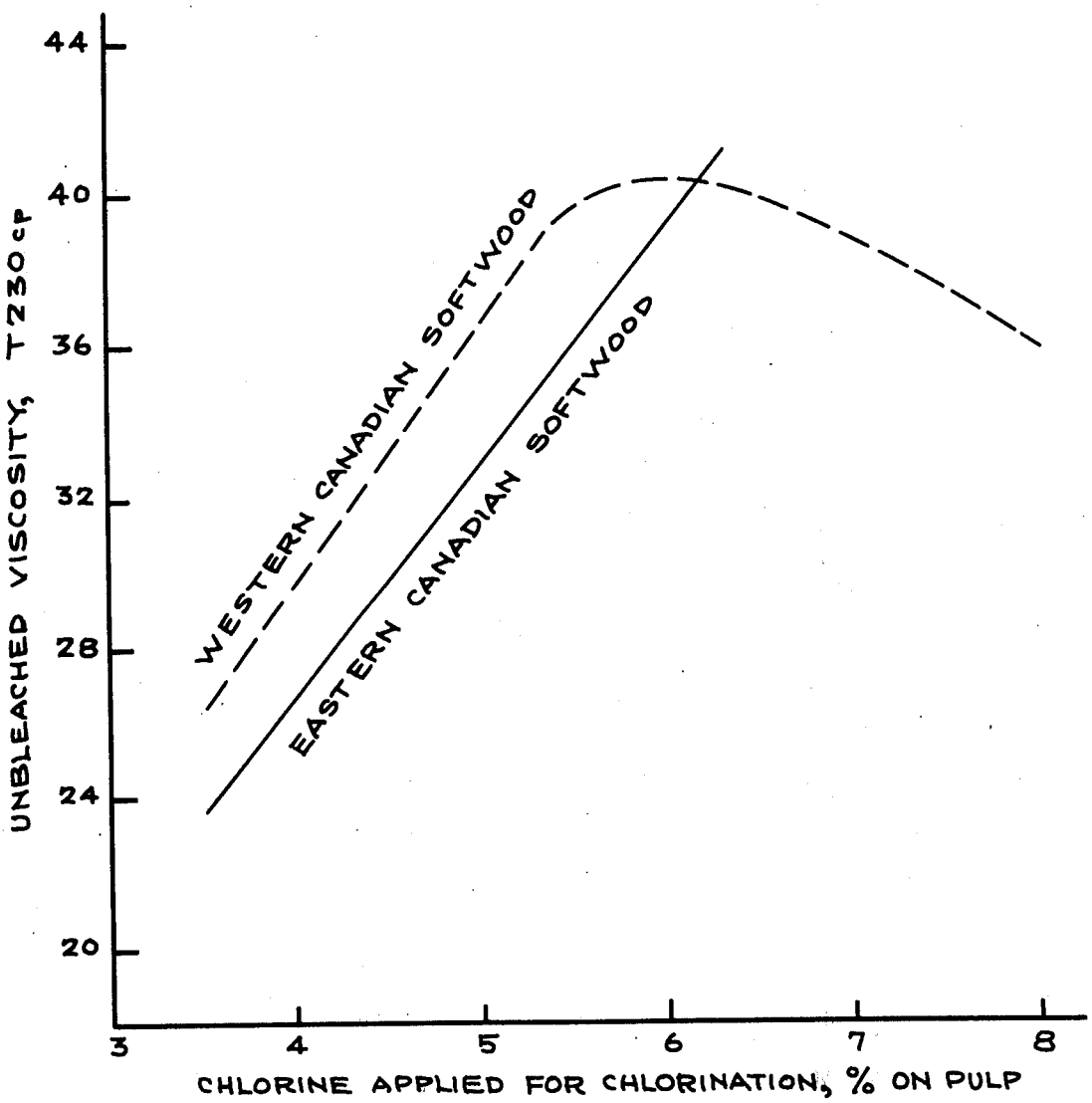
FIG. 18 is a plot of the correlation between chlorine applied for chlorination and viscosity of the unbleached pulp for two types of kraft softwood pulp.

In place of the correlation of Example *5a*, use can be made of the correlation between percent chlorine applied for chlorination and unbleached viscosity shown in FIG. 18. Because lignin can interfere with the dissolution of the cellulose in the solvent, the viscosity test becomes unreliable in the higher viscosity range. However, in the lower range of viscosity, the manually determined unbleached viscosity can be used in place of the amount of chlorine applied for chlorination in the computer programs for carrying out the processes described in Examples 1, 3 and 4.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. A system for automatically and simultaneously controlling at predetermined fixed values both the solution viscosity and brightness of a pulp during a multistage bleaching process which employs first a chlorination stage followed by a plurality of other bleaching stages, in one of which other bleaching stages a hypochlorite bleaching reagent is used and in which stage solution viscosity of said pulp is controlled, and in another subsequent bleaching stage employing a chlorine dioxide reagent final pulping brightness is controlled, comprising means for regulating the amount of addition of said hypochlorite bleaching reagent and the said chlorine dioxide reagent by means of generating two control signals which are representative of predetermined solution viscosity and brightness values, respectively, which means employs at least one optical reflectance monitoring sensor which electronically feeds reflectance values to a computer which transmits the said control signals to regulators which control the addition of said hypochlorite and chlorine dioxide bleaching reagents; one of said optical reflectance monitoring sensors monitoring the pulp subsequent to said chlorination stage and prior to said chlorine dioxide bleaching stage.

2. A system in accordance with claim 1 in which one of said optical reflectance monitoring sensors monitors the pulp subsequent to treatment with said hypochlorite bleaching reagent.

3. A system in accordance with claim 1 in which one of said optical reflectance monitoring sensors monitors the pulp prior to treatment with said hypochlorite bleaching reagent.

4. A system in accordance with claim 1 wherein one of said optical reflectance monitoring sensors monitors pulp to which hypochlorite bleaching agent has been added.

5. A system in accordance with claim 1 wherein one of said optical reflectance monitoring sensors employs the reflectance of light at two wavebands.

6. A system in accordance with claim 1 wherein one of said optical reflectance monitoring sensors employs the reflectance of light at a single waveband.

7. A system in accordance with claim 1 wherein a plurality of optical reflectance monitoring sensors is employed.

8. A process for automatically and simultaneously controlling at predetermined fixed values both the solution viscosity and brightness of a pulp bleached in a multistage bleaching process which employs a plurality of bleaching reagents, said process employs first a chlorination stage, one subsequent stage of said process employs hypochlorite bleaching reagent wherein pulp solution viscosity is controlled, in another subsequent stage subsequent to the addition of hypochlorite bleaching reagent which employs chlorine dioxide bleaching reagent final pulp brightness is controlled, in which process the amount of addition of said hypochlorite bleaching reagent and said chlorine dioxide bleaching reagent is regulated by means of two control signals which are representative of predetermined solution viscosity and brightness, respectively, said control signals being provided by at least one optical reflectance monitoring sensor which electronically feeds reflectance values to a computer which transmits the said control signals to regulators which control the addition of said hypochlorite and chlorine dioxide bleaching reagents; one of said optical reflectance monitoring sensors monitoring the pulp subsequent to said chlorination stage and prior to said chlorine dioxide bleaching stage.

9. A process in accordance with claim 8, wherein computer control of the hypochlorite addition to the hypochlorite stage is based on pulp and chemical flows to said first chlorination bleaching stage and on a signal obtained from one of said optical reflectance value measurements on washed pulp just prior to hypochlorite bleaching reagent addition, wherein said computer compensates for the time lag between the measurements of optical reflectance values made entering the said first chlorination bleaching stage and the measurement just prior to hypochlorite bleaching reagent addition, the brightness leaving the hypochlorite bleaching stage being varied with cooking degree to give a constant viscosity, and the brightness of the fully bleached pulp being controlled by a signal from another of said optical reflectance value measurements made on the pulp prior to said chlorine dioxide bleaching reagent addition.

10. A process in accordance with claim 8, wherein computer control of the hypochlorite bleaching reagent addition is based solely on a signal from one of said optical reflectance value measurements on washed pulp just prior to hypochlorite bleaching reagent addition and chlorine dioxide bleaching reagent control is based on another of said optical reflectance value measurements made just prior to chlorine dioxide bleaching reagent addition.

11. A process in accordance with claim 8, wherein pulp solution viscosity control is computer controlled and achieved by using signals of pulp and chemical flows entering the said first chlorination bleaching stage of the bleaching process to vary the set point for one of said optical reflectance value measurements made on unwashed hypochlorite bleached pulp, another signal from said optical reflectance value measurements being also used to control the chlorine dioxide bleaching reagent addition in a subsequent brightness control stage.

12. A multi-stage bleaching control process for pulp for automatically and simultaneously controlling at predetermined fixed values both the solution viscosity and brightness of said pulp, which process employs first a chlorination stage followed by a sequence of other bleaching steps in which hypochlorite bleaching reagent is employed in at least one such step, in which step said solution viscosity of said pulp is controlled, and in another bleaching step subsequent to the hypochlorite bleaching stage a chlorine dioxide bleaching agent is employed in which final pulp brightness is controlled, in which process the pulp is monitored by means of at least one optical reflectance monitoring sensor which electronically feeds a plurality of control signals to a computer, one of which signals is representative of the predetermined solution viscosity value and another is representative of the brightness value of the fully bleached pulp, said computer responding to said signals and transmitting control signals to regulators thereby controlling the addition of said hypochlorite and chlorine dioxide bleaching reagents, to control solution viscosity and brightness, respectively; one of said optical reflectance monitoring sensors monitoring the pulp subsequent to said chlorination stage and prior to said chlorine dioxide bleaching stage.

13. A bleaching process in accordance with claim 12 in which one of said optical reflectance monitoring sensors monitors the pulp subsequent to treatment with said hypochlorite bleaching reagent.

14. A bleaching process in accordance with claim 12 in which one of said optical reflectance monitoring sensors monitors the pulp prior to treatment with said hypochlorite bleaching reagent and another sensor prior to treatment with said chlorine dioxide bleaching reagent.

15. A bleaching process in accordance with claim 12 wherein one of said optical reflectance monitoring sensors monitors pulp to which hypochlorite bleaching agent has been added.

16. A bleaching process in accordance with claim 12 wherein one of said optical reflectance monitoring sensors employs the reflectance of light at two wavebands.

17. A bleaching process in accordance with claim 12 wherein one of said optical reflectance monitoring sensors employs the reflectance of light at a single waveband.

18. A bleaching process in accordance with claim 12 wherein a plurality of optical reflectance monitoring sensors is employed.

19. A bleaching control process for pulp in which both solution viscosity and brightness of said pulp are automatically and simultaneously controlled, said process employing a plurality of bleaching reagents in a sequence of stages subsequent to a first chlorination bleaching stage, one subsequent stage of which employs hypochlorite bleaching reagent wherein pulp solution viscosity variations resulting from variations in cooking degree of the unbleached pulp are compensated for, followed by a stage employing chlorine dioxide bleaching reagent wherein relatively wide brightness variations of the pulp leaving the hypochlorite are compensated for, wherein computer control is employed and which computer control of said hypochlorite stage is based on signals of pulp and chemical flows to said first chlorination bleaching stage and on a signal obtained from an optical reflectance measurement on washed pulp just prior to said hypochlorite bleaching reagent addition, wherein said computer compensates for the time lag between the measurements made entering said first chlorination bleaching stage and the optical reflectance measurement just prior to said hypochlorite bleaching reagent addition, the brightness leaving the said hypochlorite stage being varied with cooking degree to give a constant viscosity, by controlling the hypochlorite addition and the brightness of the fully bleached pulp being controlled by addition of chlorine dioxide which is in turn controlled by a singal based on an optical reflectance measurement made on the pulp prior to said chlorine dioxide bleaching reagent addition.

20. A process in accordance with claim 19, wherein said computer control of the said hypochlorite bleaching reagent addition is based solely on a signal from one of said optical reflectance measurements on washed pulp just prior to said hypochlorite bleaching reagent addition and said chlorine dioxide bleaching reagent control is based on a signal from another of said optical reflectance measurements just prior to chlorine dioxide bleaching reagent addition.

21. A process in accordance with claim 19, wherein viscosity control is achieved by using signals of pulp and chemical flows entering said first chlorination bleaching stage of the bleaching process to vary the set point for one of said optical reflectance measurements made on unwashed hypochlorite bleached pulp, one of said signals from said optical reflectance measurements being used to control the chlorine dioxide bleaching reagent addition in a final subsequent brightness control stage.

22. An apparatus for bleaching pulp which automatically and simultaneously controls to predetermined fixed values both the solution viscosity and degree of brightness of said pulp, comprising in combination, means for treating said pulp with a sequence of bleaching reagents, one of said means comprising a plurality of vessels for treating said pulp with a sequence of chlorination, hypochlorite and chlorine dioxide bleaching reagents, monitoring means consisting of at least one optical reflectance monitoring sensor which electronically feeds two control signals to a computer, which signals are representative of predetermined solution viscosity and brightness values, said computer being capable of responding to said signal and transmitting control signals to regulators thereby controlling the addition of said hypochlorite and chlorine dioxide bleaching reagents, in which apparatus the amount of addition of said hypochlorite bleaching reagent and said chlorine dioxide bleaching reagent are regulated by means of generating of said two control signals which are representative of predetermined solution viscosity and brightness, respectively, one of said monitoring sensors monitoring the pulp subsequent to the said chlorination bleaching stage and prior to the said chlorine dioxide bleaching stage.

23. An apparatus in accordance with claim 22 in which one of said monitoring sensors monitors the pulp subsequent to treatment with said hypochlorite bleaching reagent.

24. An apparatus in accordance with claim 22 in which one of said monitoring sensors monitors the pulp prior to treatment with said hypochlorite bleaching reagent.

25. An apparatus in accordance with claim 22 wherein one of said monitoring sensors monitors pulp to which hypochlorite bleaching agent has been added.

26. An apparatus in accordance with claim 22 wherein one of said monitoring sensors employs the reflectance of light at two wavebands.

27. An apparatus in accordance with claim 22 wherein one of said monitoring sensors employs the reflectance of light at a single waveband.

28. An apparatus in accordance with claim 22 wherein a plurality of monitoring sensors is employed.

* * * * *